US007920812B2

(12) United States Patent
Kosugi et al.

(10) Patent No.: US 7,920,812 B2
(45) Date of Patent: Apr. 5, 2011

(54) DEVELOPMENT DEVICE AND IMAGE FORMING APPARATUS THAT USES THIS DEVICE

(75) Inventors: Hideki Kosugi, Kanagawa (JP); Yasuyuki Ishii, Tokyo (JP); Tomoko Takahashi, Kanagawa (JP); Masaaki Yamada, Tokyo (JP); Ichiro Kadota, Kanagawa (JP); Yoshinori Nakagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 109 days.

(21) Appl. No.: 12/261,302

(22) Filed: Oct. 30, 2008

(65) Prior Publication Data

US 2009/0123193 A1 May 14, 2009

(30) Foreign Application Priority Data

Nov. 2, 2007 (JP) ..... 2007-285751

(51) Int. Cl.
*G03G 15/08* (2006.01)

(52) U.S. Cl. ..... 399/266; 399/291

(58) Field of Classification Search ..... 399/265, 399/266, 290, 291; 430/123.2
See application file for complete search history.

(56) References Cited

U.S. PATENT DOCUMENTS

| | | | | |
|---|---|---|---|---|
| 5,742,884 | A * | 4/1998 | Germain et al. | 399/266 |
| 6,658,227 | B2 | 12/2003 | Oyama et al. | 399/267 |
| 6,708,014 | B2 | 3/2004 | Miyaguchi et al. | 399/266 |
| 6,947,691 | B2 | 9/2005 | Miyaguchi et al. | 399/266 |
| 7,308,222 | B2 | 12/2007 | Nakagawa et al. | 399/265 |
| 7,313,336 | B2 | 12/2007 | Kadota et al. | 399/49 |
| 7,340,204 | B2 | 3/2008 | Nakazato et al. | 399/291 |
| 7,359,660 | B2 | 4/2008 | Nakazato et al. | 399/259 |
| 7,412,190 | B2 | 8/2008 | Kadota et al. | 399/254 |
| 2006/0216071 | A1 | 9/2006 | Yamada et al. | 399/279 |
| 2006/0251449 | A1 | 11/2006 | Takahashi et al. | 399/265 |
| 2007/0013924 | A1 | 1/2007 | Sakai et al. | 358/1.4 |
| 2007/0015071 | A1 | 1/2007 | Tsukamoto et al. | 430/45 |
| 2007/0086811 | A1 | 4/2007 | Tsukamoto et al. | 399/265 |
| 2007/0160395 | A1 | 7/2007 | Kosugi et al. | 399/265 |
| 2007/0212121 | A1 | 9/2007 | Takahashi et al. | 399/265 |
| 2007/0242985 | A1 | 10/2007 | Aoki et al. | 399/274 |
| 2008/0089720 | A1 | 4/2008 | Tsukamoto et al. | 399/260 |
| 2008/0089723 | A1 | 4/2008 | Tsukamoto et al. | 399/281 |
| 2008/0124138 | A1 | 5/2008 | Kosugi et al. | 399/285 |

FOREIGN PATENT DOCUMENTS

| | | | |
|---|---|---|---|
| JP | 2001-139144 A | * | 5/2001 |
| JP | 2002-341656 | | 11/2002 |
| JP | 2003-084566 A | * | 3/2003 |
| JP | 2007-133376 | | 5/2007 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

A development device provided with a first electrode layer and a second electrode layer, which are laminated so as to overlap one another in a normal direction with respect to the surface of the roller part of the toner bearing roller. A plurality of openings are provided in the second electrode layer, over the entire latent image bearable area of a photosensitive body in the orthogonal-to-movement direction. The toner on the surface of the roller part is caused to hop between a plurality of spots directly beneath the openings that respectively exist directly beneath the plurality of openings in the second electrode layer, and a plurality of spots between the openings that respectively exist between the plurality of openings in the second electrode layer, within the entire area of the first electrode layer which is uniformly formed in the roller circumferential direction.

24 Claims, 17 Drawing Sheets

DEVELOPMENT DEVICE AND IMAGE FORMING APPARATUS THAT USES THIS DEVICE

BACKGROUND OF THE INVENTION

1. Field of the Invention

The present invention relates to a development device for developing a latent image by causing the adherence of a toner, which is being made to hop between the electrodes on the surface of a toner bearing member that comprises a plurality of electrodes, to the latent image on a latent image bearing member of an image forming apparatus. Further, the present invention relates to an image forming apparatus that uses this development device.

2. Description of the Related Art

Instead of a conventional development device that uses a toner, which has been made to adhere to the surface of a development roller or the like, in development, a development device that uses a toner, which is caused to hop on the surface of a toner bearing member like the disclosures in Japanese Patent Laid-Open No. 2002-341656 (referred to herein as Prior Art 1) and Japanese Patent Laid-Open No. 2007-133376 (referred to herein as Prior Art 2) in development, is known.

In these prior art development devices, hopping causes the toner, which is not demonstrating adsorption force relative to the surface of the toner bearing member, to transfer to the latent image bearing member from the surface of the toner bearing member. Consequently, in a conventional one-component development system or two-component development system, it is possible to realize more low-potential development than expected. For example, it is also possible to cause toner to selectively adhere to an electrostatic latent image for which the potential difference with the surrounding non-image part is a mere several tens of volts [V].

However, in these development devices, if any of the electrodes are partially damaged, it is highly likely that toner hopping performance on the toner bearing member will deteriorate enough to impede development. Specifically, the size in the lateral direction (width direction) of a strip-shaped electrode, which is formed on a toner transporting substrate and toner bearing roller serving as the toner bearing member, is extremely narrow at around several tens of micrometers (μm). The reason for making the electrode narrow like this is so that, no matter what location in the width direction of the electrode that the toner resides on the electrode, the toner can be made to reliably hop from this location toward the adjacent electrode. The surface of the toner bearing member is covered with a surface layer comprising an insulating material for the purpose of avoiding the injection of a charge into the toner from the electrode, but variations in precision at the time of fabrication and partial scraping can result in extremely thin spots in the surface layer. This can cause a sudden discharge of electricity between electrodes via these thin spots, partially damaging the electrodes. Further, there are also cases in which the electrodes are partially damaged by workers accidentally bumping their tools against the electrodes when carrying out maintenance. When these partially damaged areas electrically disconnect the narrow electrodes, electric current no longer flows to locations in the current path downstream from these damaged spots. Then, toner hopping performance is lost in these downstream locations.

SUMMARY OF THE INVENTION

With the foregoing in view, an object of the present invention is to provide a development device and image forming apparatus that make it possible to curb the occurrence of development defects resulting from partial damage caused to an electrode of the toner bearing member.

In an aspect of the present invention, a development device comprises a toner bearing member that causes a toner borne on its surface to hop, and transports the toner that is hopping on the surface of the toner bearing member to a development area opposite a latent image bearing member of an image forming apparatus along with the surface movement of the toner bearing member, and develops a latent image on the latent image bearing member by causing the hopping toner to adhere to the latent image in the development area. The development device further comprises a first electrode layer and a second electrode layer laminated so as to overlap one another in a normal direction with respect to the surface of the toner bearing member; and a plurality of openings which are provided in, of these electrode layers, the second electrode layer existing in the upper location that is closer to the surface of the toner bearing member and which are independently arranged in a matrix in both the direction of surface movement of the toner bearing member and an orthogonal-to-movement direction which is the direction orthogonal to the surface movement direction, these openings being provided over an entire latent image bearable area of the latent image bearing member in the orthogonal-to-movement direction. The toner on the surface of the toner bearing member is caused to hop between a plurality of spots directly beneath the openings that respectively exist directly beneath the plurality of openings in the second electrode layer, and a plurality of spots between the openings that respectively exist between the plurality of openings in the second electrode layer, within an entire area of the first electrode layer in the surface direction of the toner bearing member.

In another aspect of the present invention, a development device comprises a toner bearing member that causes a toner borne on its surface to repeatedly hop in a prescribed direction, and moves the toner on the surface of the toner bearing member to a development area opposite a latent image bearing member of an image forming apparatus by the repeated hopping in the prescribed direction, and develops a latent image on the latent image bearing member by causing the hopping toner to adhere to the latent image in the development area. The development device further comprises three or more electrode layers laminated so as to overlap one another in a normal direction with respect to the surface of the toner bearing member; and a plurality of openings which are provided in, of these electrode layers, an uppermost electrode layer existing in the uppermost location that is closest to the surface of the toner bearing member, and an intermediate layer existing between the uppermost electrode layer and a lowermost electrode layer existing in the lowermost location that is the furthest away from the surface of the toner bearing member, the openings extending in the surface direction of the toner bearing member, which is a direction that is orthogonal to the prescribed direction, and being aligned in the prescribed direction. The toner on the surface of the toner bearing member is caused to move in the prescribed direction by causing the toner to hop between a spot directly beneath opposing openings, which is a lowermost electrode layer spot that exists directly beneath an uppermost electrode layer opening and an intermediate electrode layer opening that face one another in a lamination direction, and a spot directly beneath the opening, which is a spot between the openings on the intermediate electrode layer, and is also a spot that exists directly beneath the opening in the uppermost electrode layer, causing the toner top hop between the spot directly beneath the opening in the intermediate electrode layer and a spot between the openings, which is a spot on the uppermost electrode layer between its own openings, and causing the toner to hop between the spot between the openings on the uppermost electrode layer and the spot directly beneath the opposing openings on the lowermost electrode layer.

In another aspect of the present invention, an image forming apparatus comprises a latent image bearing member for bearing a latent image; and a development device for developing the latent image on the latent image bearing member. The development device comprises a toner bearing member that causes a toner borne on its surface to hop, and transports the toner that is hopping on the surface of the toner bearing member to a development area opposite the latent image bearing member of the image forming apparatus along with the surface movement of the toner bearing member, and develops the latent image on the latent image bearing member by causing the hopping toner to adhere to the latent image in the development area. The development device further comprises a first electrode layer and a second electrode layer laminated so as to overlap one another in a normal direction with respect to the surface of the toner bearing member; and a plurality of openings which are provided in, of these electrode layers, the second electrode layer existing in the upper location that is closer to the surface of the toner bearing member and which are independently arranged in a matrix in both the direction of surface movement of the toner bearing member and an orthogonal-to-movement direction which is the direction orthogonal to the surface movement direction, these openings being provided over an entire latent image bearable area of the latent image bearing member in the orthogonal-to-movement direction. The toner on the surface of the toner bearing member is caused to hop between a plurality of spots directly beneath the openings that respectively exist directly beneath the plurality of openings in the second electrode layer, and a plurality of spots between the openings that respectively exist between the plurality of openings in the second electrode layer, within an entire area of the first electrode layer in the surface direction of the toner bearing member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Figure 1:
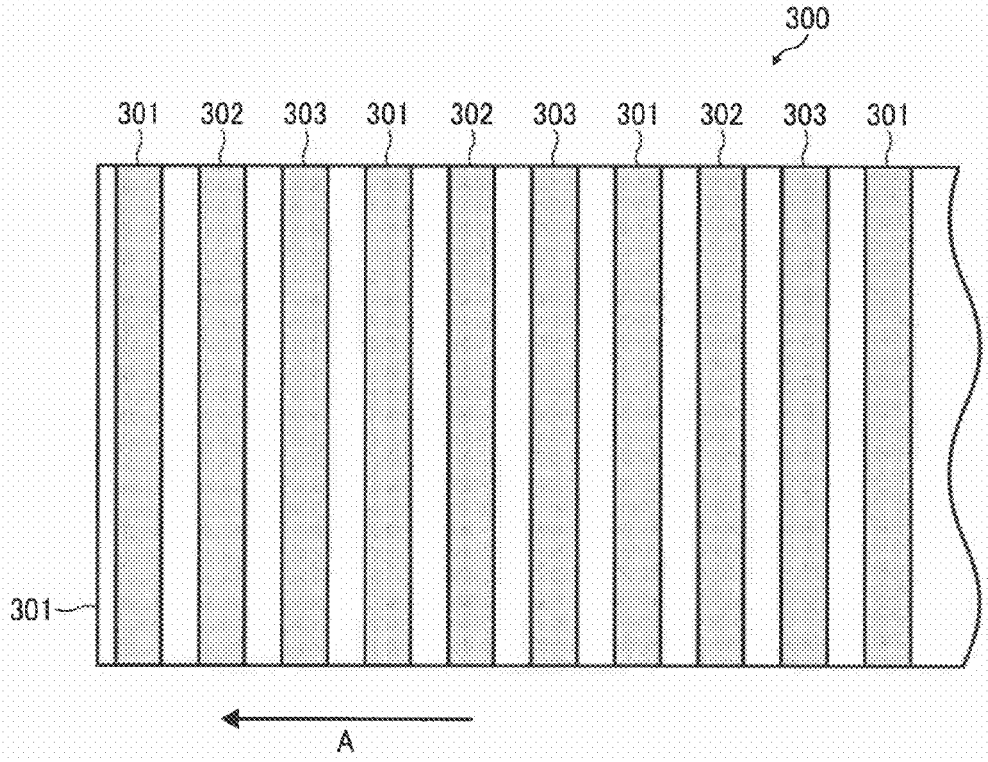
FIG. 1 PRIOR ART
FIG. 1 is a plan view showing a toner transporting substrate in a development device disclosed in Prior Art 1.

Prior to explaining the present invention, the prior art related to the present invention, and the problems the prior art was supposed to solve will be explained by referring to the drawings.

Figure 2:
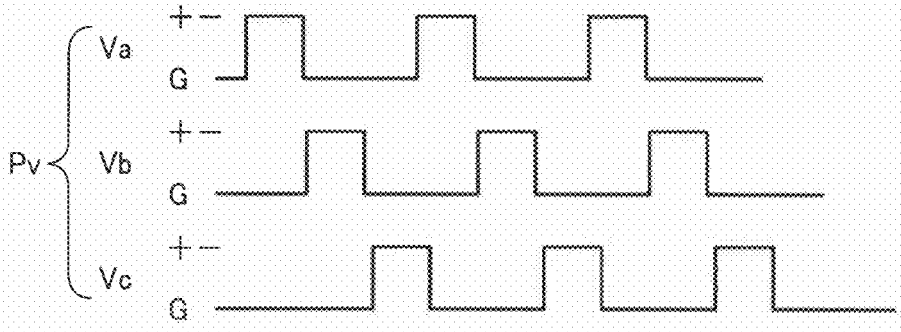
FIG. 2 PRIOR ART
FIG. 2 is a graph showing the waveform of a pulse voltage applied to the respective electrodes of the toner transporting substrate in the development device disclosed in Prior Art 1.

Referring to FIG. 1 of the drawings, a toner carrying substrate that serves as the toner bearing member in the development device disclosed in the above-mentioned Prior Art 1 is shown. In this drawing, the toner carrying substrate 300 has a plate-shaped insulating substrate 301, and a plurality of strip-shaped electrodes formed on the surface thereof. These electrodes comprise an A-phase electrode 302, B-phase electrode 303 and C-phase electrode 304, and are formed so as to repeatedly line up in the order of A-phase, B-phase, C-phase at prescribed intervals in the lateral direction. The A-phase electrodes 302, B-phase electrodes 303 and C-phase electrodes 304 are respectively linked in areas not shown in the drawing. Then, an A-phase pulse voltage Va, which is shown in FIG. 2, is applied to the A-phase electrodes 302 by a power source not shown in the drawing. Further, a B-phase pulse voltage Vb, which is shown in FIG. 2, is applied to the B-phase electrodes 303. Further, a C-phase pulse voltage Vc, which is shown in FIG. 2, is applied to the C-phase electrodes 304. These pulse voltages $P_v$ are generated at mutually phase-shifted cycles as shown in the drawing. When this pulse voltage is applied, a toner not shown in the drawing commences sequentially hopping from the A-phase electrodes 302 to the B-phase electrodes 303, and from the B-phase electrodes 303 to the C-phase electrodes 304, and from the C-phase electrodes 304 to the A-phase electrodes 302. Consequently, the toner moves along the surface of the toner carrying substrate 300 in the direction indicated by arrow A in the drawing. Then, the toner, which is hopping in the development area facing a latent image bearing member not shown in the drawing, adheres to an electrostatic latent image on the latent image bearing member. Consequently, the electrostatic latent image is developed by the toner and becomes a toner image.

Figure 3:
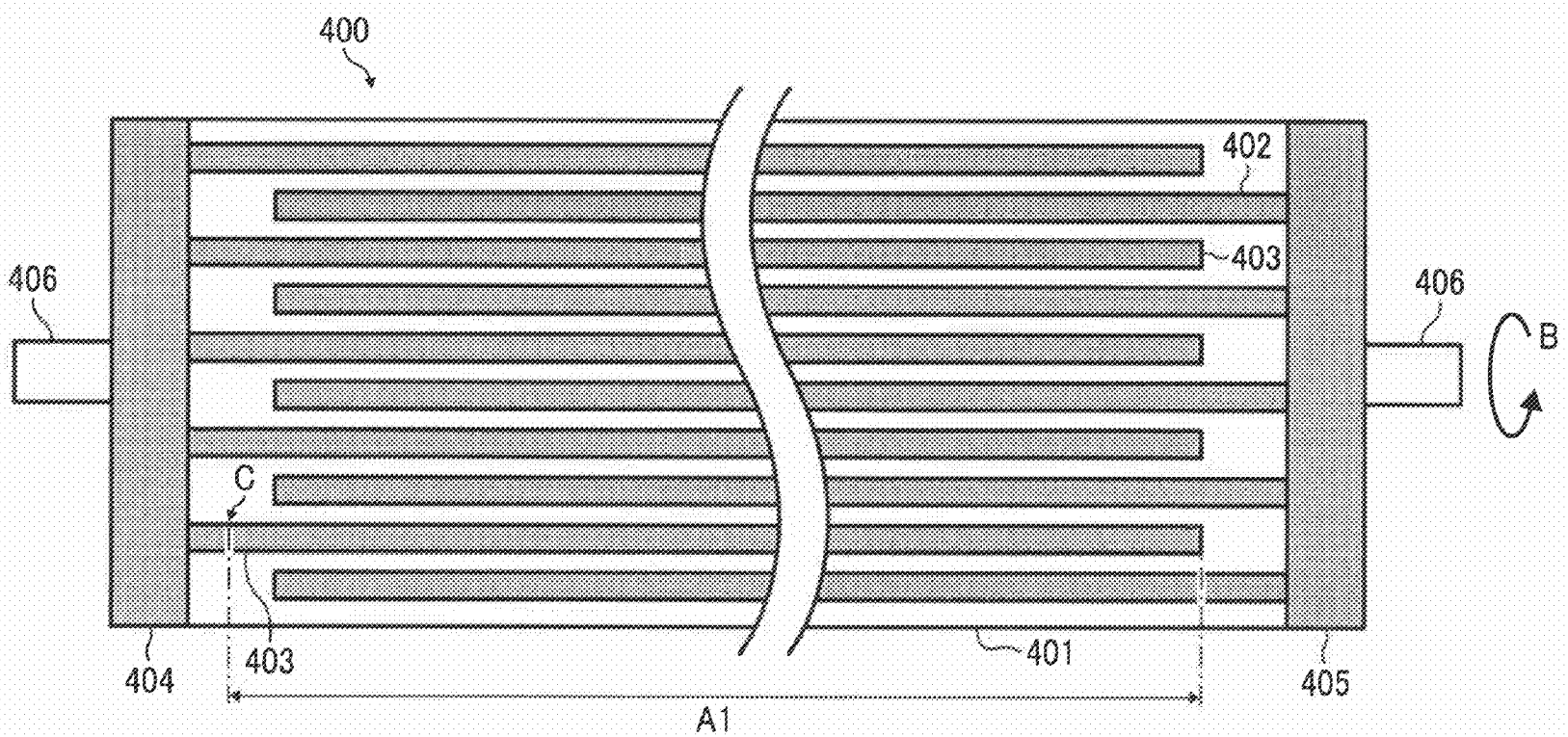
FIG. 3 PRIOR ART
FIG. 3 is a plan view showing the configuration of a toner bearing roller in the development device disclosed in Prior Art 2.

Referring to FIG. 3 of the drawings, a toner bearing roller 400 that serves as the toner bearing member in the development device disclosed in the above-mentioned Prior Art 2 is shown. This toner bearing roller 400 does not transport the toner to the development area via hopping, but rather transports the toner to the development area in accordance with the rotation of the roller. Specifically, the toner bearing roller 400 has an insulating roller part 401; and a plurality of strip-shaped electrodes formed on the surface thereof. Then, a shaft member 406, which respectively protrudes from both ends of the roller part 401, is rotationally driven in the direction of arrow B in the drawing by a not-shown drive system while being rotatably supported. The plurality of electrodes formed on the surface of the roller part 401 comprises a plurality of first electrodes 402 and second electrodes 403, and is formed so as to repeatedly line up in the order of first electrode 402 and second electrode 403 at prescribed intervals in the circumferential direction of the roller. A first flange 404, which is made from metal, is affixed at the one end of the toner bearing roller 400 in the axial direction, and makes contact with the one end of the respective first electrodes 402 in the longitudinal direction. Further, a second flange 405, which is made from metal, is affixed at the other end of the toner bearing roller 400 in the axial direction, and makes contact with the other end of the respective second electrodes 403 in the longitudinal direction.

Figure 4:
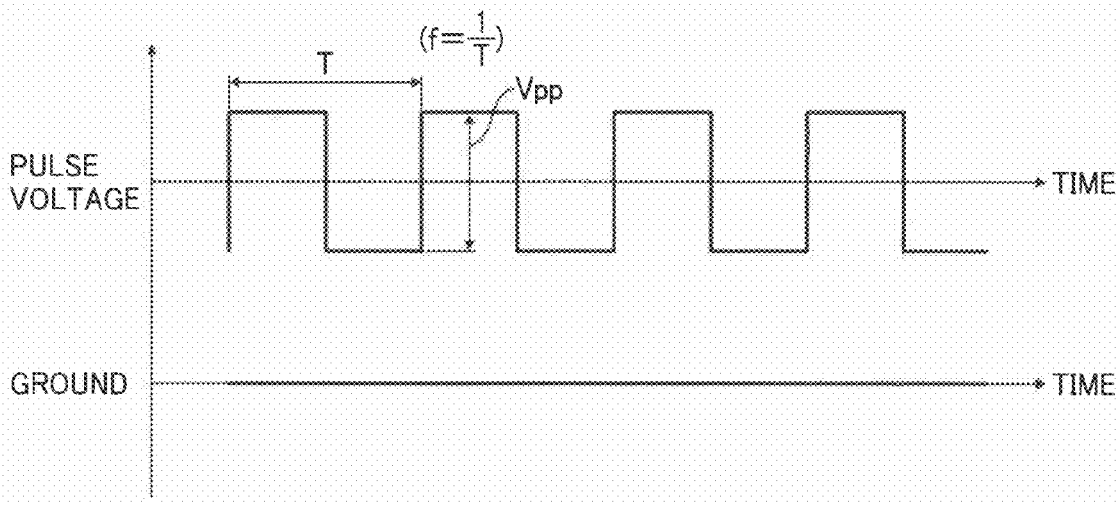
FIG. 4 PRIOR ART
FIG. 4 is a graph showing the waveform of a pulse voltage applied to the respective electrodes of the toner bearing roller in the development device disclosed in Prior Art 2.

The pulse voltage shown in FIG. 4 is applied to the first electrodes 402 by way of a not-shown contact electrode, which slidingly rubs against the first flange 404 that rotates together with the roller part 401. Further, as shown in the drawing, the second electrode 403 is grounded by way of a not-shown contact electrode, which slidingly rubs against the second flange 405 that rotates together with the roller part 401. Consequently, the toner repeatedly hops between the first electrode 402 and the second electrode 403 on the surface of the toner bearing roller 400, moving back and forth between the two electrodes. The hopping toner is transported to the development area by rotating the toner bearing roller 400 in the state in which the toner is moving back and forth on the surface like this.

In these development devices, toner, which by hopping is not exhibiting adsorptive force relative to the surface of the toner bearing member, is transferred from the surface of the toner bearing member to the latent image bearing member. Consequently, in a conventional one-component development system or two-component development system, it is possible to realize more low-potential development than expected. For example, it also possible to cause toner to selectively adhere to an electrostatic latent image for which the potential difference with the surrounding non-image part is a mere several tens of volts [V].

However, in these prior art development devices, if any of the electrodes is partially damaged, it is highly likely that the toner hopping performance of the toner bearing member will deteriorate enough to impede development. Specifically, the size in the lateral direction (width direction) of a strip-shaped electrode, which is formed on a toner carrying substrate 300 and toner bearing roller 400 serving as the toner bearing member, is extremely narrow at around several tens of micrometers (μm). The reason for making the electrode narrow like this is so that, no matter what location in the width direction of the electrode that the toner resides on the electrode, the toner can be made to reliably hop from this location toward the adjacent electrode. The surface of the toner bearing member is covered with a surface layer comprising an insulating material for the purpose of avoiding the injection of an electric charge into the toner from the electrode, but variations in precision at the time of fabrication and partial scraping can result in extremely thin spots in the surface layer. This can cause a sudden discharge of electricity between electrodes via these thin spots, partially damaging the electrodes. Further, there are also cases in which the electrodes are partially damaged by workers accidentally bumping their tools against the electrodes when carrying out maintenance. When these partially damaged areas electrically disconnect the narrow electrodes, electric current no longer flows to places along the current path downstream from these damaged locations. Then, toner hopping performance is lost in the locations downstream thereof.

For example, in the toner bearing roller 400 shown in FIG. 3, it is supposed that, of the plurality of second electrodes 403, partial damage has occurred at the spot on the second electrode 403 indicated by the tip of arrow C. In this case, electrical current from the power source ceases to be supplied to the area of this second electrode 403 indicated by A1 in the drawing. Thus, toner hopping performance is lost in the A1 area of this second electrode 403, and the toner on area A1 adheres as-is to the roller surface without hopping. Then, when this second electrode 403 advances to the development area in line with the rotation of the roller, insufficient toner is supplied to the latent image on the latent image bearing member, causing defective development.

A first embodiment of a digital camera color printer (hereinafter will simply be called the printer) will be explained hereinbelow as an image forming apparatus that uses the present invention.

Figure 5:
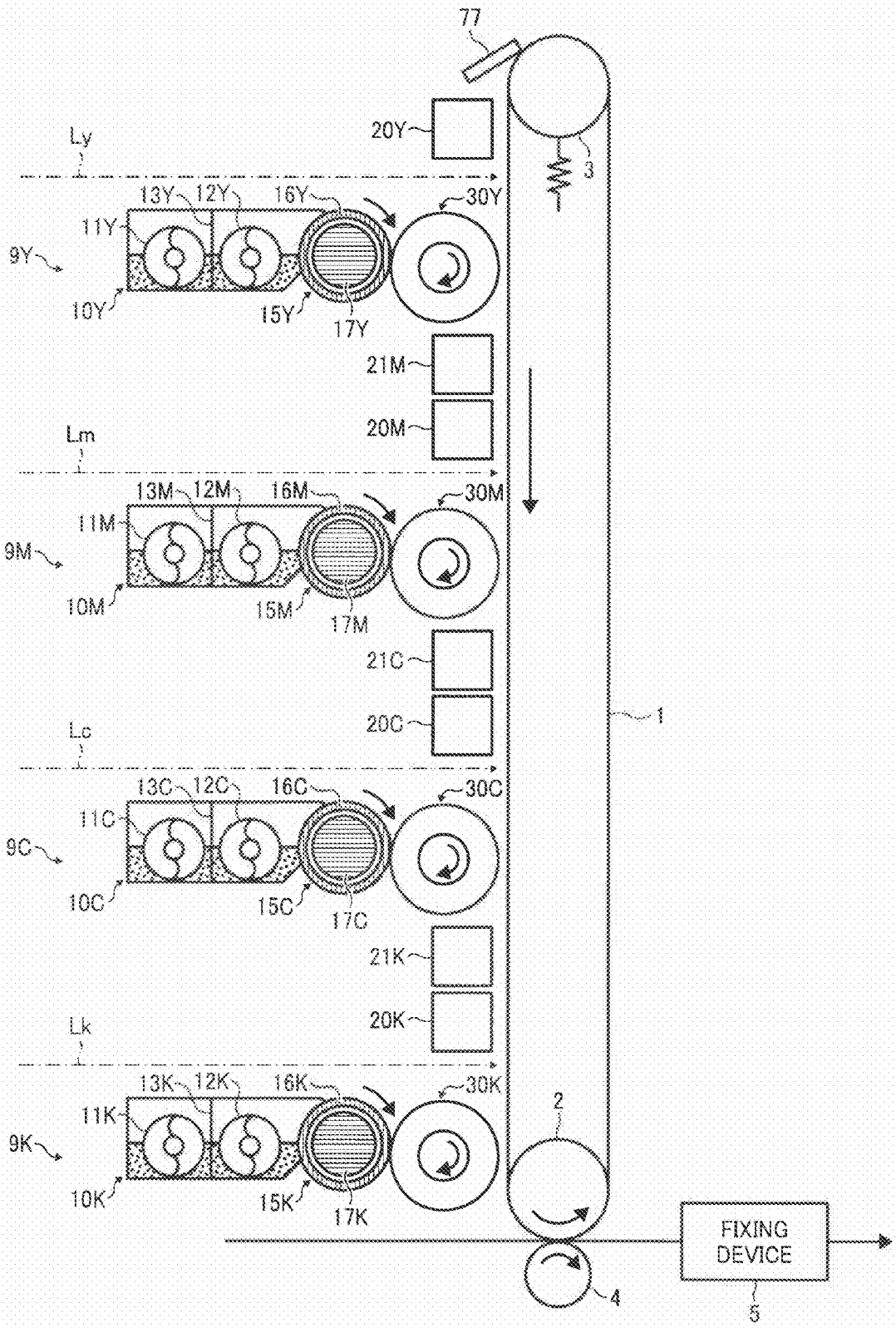
FIG. 5 is a diagram showing the approximate configuration of a printer related to a first embodiment of the present invention.

Referring to FIG. 5 of the drawings, an approximate configuration of a printer related to the first embodiment is shown. This printer comprises a photosensitive belt 1 as the latent image bearing member. This photosensitive belt 1 comprises an endless-shaped belt body, and an organic photosensitive layer that covers the entire surface of the exterior side (the outside surface side of the loop) of the belt body. Then, this photosensitive belt 1 is stretched by a drive roller 2, which is rotationally driven in the counterclockwise direction by not-shown driving means, and a rotationally drivable tension roller 3 in an orientation that extends linearly in the vertical direction. The photosensitive belt 1 engages in endless movement in the counterclockwise direction in the drawing in line with the rotational driving of the drive roller 2.

Development devices 9Y, M, C, K, which respectively form yellow (Y), magenta (M), cyan (C) and black (K) images, are arranged in order so as to stack up in the vertical direction to the left side of the photosensitive belt 1 in the drawing. Each development device (9Y, M, C, K) has a developer hopper (10Y, M, C, K), a developer bearing roll (15Y, M, C, K), a charging device comprising a corona charger (20Y, M, C, K), and a toner bearing roller, which is the toner bearing member (30Y, M, C, K). Further, with the exception of the Y development device 9Y, the development devices (9M, C, K) have neutralization devices (21M, C, K), which respectively comprise neutralizing lamps.

The charging devices 20Y, M, C, K uniformly charge the exterior surface of the photosensitive belt 1 to a negative polarity that is the same as the charged polarity of the toner, by generating corona discharge toward the exterior surface of the photosensitive belt 1. A scorotron charger can be cited as an example of this charging device. The charging device can use a system that generates a discharge between the charging member and the photosensitive belt 1 while either causing the charging member of the charging roller to which the charging bias is applied to make contact with or come into close proximity to the exterior surface of the photosensitive belt 1.

The neutralization devices 21M, C, K neutralize the electrical charge of the exterior surface of the photosensitive belt 1 by uniformly irradiating light onto the exterior surface of the photosensitive belt 1. Instead of neutralization by light irradiation, the neutralization device can also use a system that neutralizes the surface of the belt using an alternating voltage discharge.

An optical writing unit not shown in the drawing is arranged on the left side of the four development devices 9Y, M, C, K in the drawing. This optical writing unit can individually form Y, M, C and K electrostatic latent images on the exterior surface of the photosensitive belt 1 by carrying out optical scanning relative to the exterior surface of the photosensitive belt 1 using a known optical system comprising a laser diode, polygon mirror, reflection mirror, image-forming lens or the like.

Other than the fact that the Y, M, C, K development devices 9Y, M, C, K use mutually different colored toners, these devices constitute practically the same configuration, and as such, only the Y development device 9Y will be explained hereinbelow.

A two-component developer (hereinafter simple called the developer) comprising a magnetic carrier and a Y toner is held inside the developer hopper 10Y of the Y development device 9Y. This developer mixes together polyester toner particulates of approximately 6 [μm] in diameter with 50 [μm]-diameter magnetic carrier particles at a ratio of 7 to 8 wt %. The developer hopper 10Y comprises a first chamber, which includes a first transporting screw 11Y, M, C, K that is rotationally driven by not-shown driving means, and a second chamber, which includes a second transporting screw 12Y, M, C, K that is rotationally driven by not-shown driving means. The first chamber and second chamber are partitioned by a partitioning wall 13Y that exists therebetween, but not-shown openings are respectively provided at both ends of the partitioning wall 13Y in the orthogonal direction relative to the paper on which the drawing is drawn, and the two chambers are connected to one another via these openings.

The first transporting screw 11Y inside the first chamber transports the developer inside the first chamber from the front side to the back side in the orthogonal direction relative to the paper on which the drawing is drawn by being rotationally driven by not-shown driving means. Then, the developer enters into the second chamber through the not-shown opening provided in the partitioning wall 13Y on the back side end of the first chamber in this same direction. Furthermore, a not-shown toner density sensor comprising a magnetic permeability sensor is arranged in the bottom wall of the first chamber, and the density of the Y toner is detected when the developer passes through the location opposite this toner density sensor pursuant to the rotation of the first transporting screw 11Y.

The second transporting screw 12Y inside the second chamber transports the developer from the back side to the front side in the same direction by being rotationally driven by not-shown driving means. A developer bearing roll 15Y is arranged in a parallel orientation to the second transporting screw 12Y in the right side of the drawing of the second transporting screw 12Y, which transports the developer like this. This developer bearing roll 15Y comprises rotating sleeve 16Y, which comprises a non-magnetic pipe that is rotationally driven in the clockwise direction in the drawing, and magnet roller 17Y, which is affixed on the inside of the rotating sleeve 16Y so as not to rotate together with the sleeve. A portion of the developer transported by the second transporting screw 12Y is scooped up to the surface of the rotating sleeve 16Y by the magnetic force generated by the magnet roller 17Y. Then, subsequent to the thickness of this developer being regulated by a not-shown doctor blade arranged so as to maintain a prescribed gap with the rotating sleeve 16Y, the developer is transported to a toner supply area that faces a toner bearing roller 30Y, which will be described hereinbelow. In this toner supply area, the Y toner inside the developer that has been borne on the surface of the rotating sleeve 16Y is supplied to the surface of the toner bearing roller 30Y.

Corresponding developer bearing rolls 15M, 15C, and 15K, which comprise rotating sleeves 16M, 16C, and 16K, and magnet rollers 17M, 17C, and 17K, respectively, are provided in development devices 9M, 9C, and 9K, respectively.

The developer of subsequent to the Y toner being supplied to the toner bearing roller 30Y in the above-mentioned toner supply area is returned to the second transporting screw 12Y after being moved to a location opposite the second chamber pursuant to the rotation of the rotating sleeve 16Y. Then, when the developer is transported to the front side end inside the second chamber in the orthogonal direction relative to the paper on which the drawing is drawn, this developer returns to the first chamber through the not-shown opening in the partitioning wall 13Y.

The result of the detection of the Y toner density by the above-mentioned toner density sensor is sent to a not-shown control part as a voltage signal. This control part comprises data storage means such as RAM, in which there is stored data such as a Y Vtref, which is a target value for the output voltage from the toner density sensor, or a C Vtref, M Vtref and K Vtref, which are target values for the output voltages from the C, M and K toner density sensors mounted in the other development devices. In the Y development device 9Y, the Y Vtref is compared against the value of an output voltage from the Y toner density sensor, and a not-shown Y toner supplying device is driven only for a period of time corresponding to the comparison result. In accordance with this driving, an appropriate amount of Y toner is supplied to the first chamber relative to the developer for which the Y toner density was lowered by the supplying of toner to the toner bearing roller 30Y. The Y toner density of the developer inside the first chamber is thus maintained within a prescribed range. The same toner supply control is also implemented in the development devices (10M, C, K) for the other colors.

The toner bearing roller 30Y is rotational driven in the clockwise direction in the drawing while causing the Y toner supplied from the rotating sleeve 16Y to hop on the circumferential surface of the roller part. Then, the Y toner, which is hopping on the circumferential surface, is transported to the development area opposite the photosensitive belt 1 by the movement of the roller circumferential surface in line with this rotational drive.

When the photosensitive belt 1, which is carrying out endless movement in the counterclockwise direction in the drawing, passes though the winding area relative to the tension roller 3, this belt 1 advances to the location opposite the charging device 20Y of the Y development device 9Y. Then, subsequent to being uniformly charged to negative polarity by the charging device 20Y, the photosensitive belt 1 is subjected to optical scanning by a laser beam Ly emitted from the above-mentioned optical writing unit, and bears a Y electrostatic latent image. Thereafter, the photosensitive belt 1 advances to the Y development area, which is the location opposite the toner bearing roller 30Y of the Y development device 9Y. In the Y development area, the Y toner that flew up to the surface of the toner bearing roller 30Y adheres to the Y electrostatic latent image being borne on the exterior surface of the photosensitive belt 1. Consequently, the Y electrostatic latent image being borne on the exterior surface of the photosensitive belt 1 is developed and becomes a Y toner image.

The exterior surface of the photosensitive belt 1, on which a Y toner image has been formed like this, subsequent to advancing to the location opposite the neutralization device 21M of the M development device 9M in line with the endless movement of the belt and being electrically neutralized, the photosensitive belt 1 advances to the location opposite the charging device 20M and is uniformly charged to negative polarity. Thereafter, subsequent to being subjected to optical scanning by a laser beam Lm emitted from the above-mentioned optical writing unit and bearing an M electrostatic latent image, the photosensitive belt 1 advances to the M development area, which is the location opposite the toner bearing roller 30M of the M development device 9M. In the M development area, the M toner that flew up to the surface of the toner bearing roller 30M adheres to the M electrostatic latent image being borne on the exterior surface of the photosensitive belt 1. Consequently, the M electrostatic latent image being borne on the exterior surface of the photosensitive belt 1 is developed to become an M toner image, and a two-color toner image is formed on the surface of the photosensitive belt 1 by the superposing of Y and M.

Thereafter, C and K electrostatic latent images are sequentially formed on the exterior surface of the photosensitive belt 1 in the same way, and a C toner image and K toner image are formed. As with toner images Y and M, during formation of toner images C and K, the photosensitive belt 1 is subjected to optical scanning by laser beam Lc and laser beam Lk, respectively. Consequently, a four-color toner image is formed on the exterior surface of the photosensitive belt 1 by the superposing of Y, M, C and K.

A transfer roller 4, which is transfer means, is arranged beneath the photosensitive belt 1 so as to form a transfer nip by making contact with the exterior surface side of the photosensitive belt 1 at the winding spot relative to the driving roller 2. A positive polarity charging bias, which is the reverse polarity of the toner charge polarity, is applied to this transfer roller 4 by a not-shown power source.

This printer comprises sheet feeding means equivalent to a resist roller that feeds recording paper, which is the recording medium, to the transfer nip at a timing that can be synchronized to the four-color toner image on the exterior surface of the photosensitive belt 1. The four-color toner image, which enters into the transfer nip and is brought into close contact with the recording paper in line with the endless movement of the photosensitive belt 1, is transferred to the recording paper from the exterior surface of the belt by the transfer field formed inside the transfer nip and nip pressure action. Consequently, the four-color toner image combines with the white color of the recording paper to become a full-color toner image.

A fixing unit 5 comprising means for heating the recording paper is arranged on the right side of the transfer nip in the drawing. The recording paper, which has passed through the transfer nip, is affixed with a full-color toner image upon passing through this fixing unit 5. Then, after exiting the fixing unit 5, the recording paper is discharged to the outside of the printer.

Next, the characteristic configuration of this printer will be explained.

Figure 6:
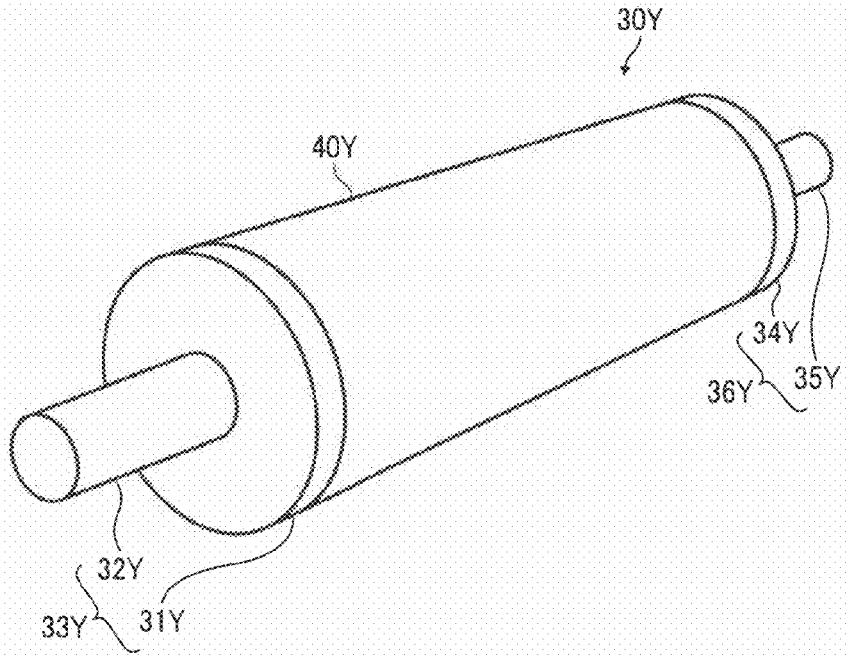
FIG. 6 is an oblique view showing the exterior of the yellow (Y) toner bearing roller in the printer related to the first embodiment of the present invention.

Referring to FIG. 6 of the drawing, the Y toner bearing roller 30Y is shown. In this drawing, the toner bearing roller 30Y has a cylindrical roller part 40Y; a first flange-shaft member 33Y comprising a first flange 31Y that is made of metal, and a first shaft member 32Y, which are affixed at the one end of the roller part 40Y in the axial direction; and a second flange-shaft member 36Y comprising a second flange 34Y that is made of metal, and a second shaft member 35Y, which are affixed at the other end of the roller part 40Y in the axial direction.

Figure 7:
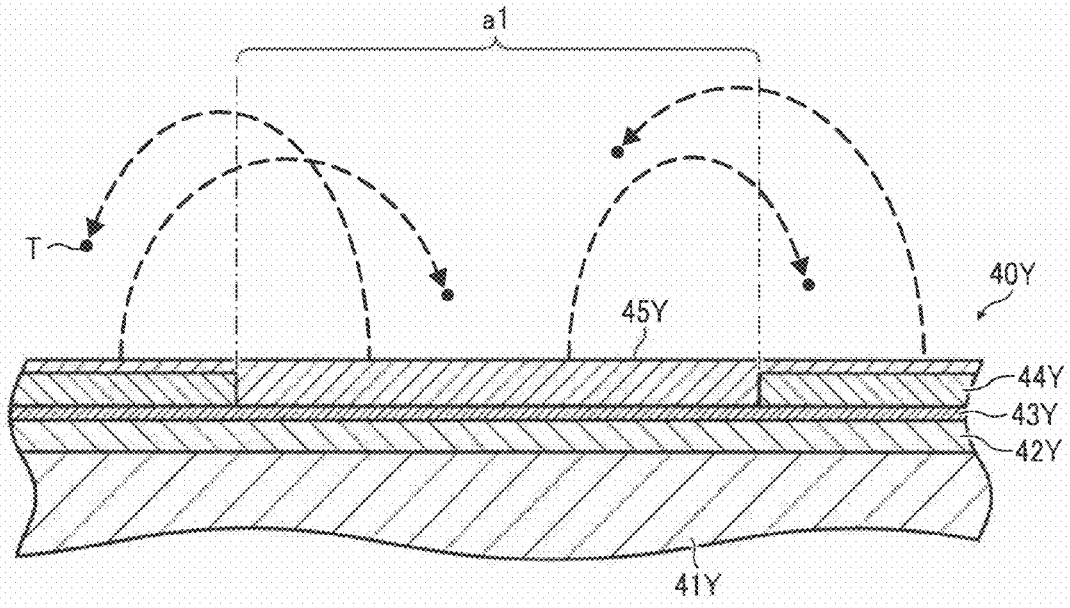
FIG. 7 is an enlarged cross-sectional view showing the roller part of the Y toner bearing roller in the printer related to the first embodiment of the present invention.

Referring to FIG. 7 of the drawing, an enlargement of the roller part 40Y is shown. Further, referring to FIG. 8 in the drawing, an enlargement of the one end of the roller part 40Y in the axial direction is shown. As shown in FIG. 7, the roller part 40Y has a roller body 41Y, which comprises an insulating material such as the acrylic resin in FIG. 8, and a first electrode layer 42Y, insulation layer 43Y, second electrode layer 44Y and surface layer 45Y sequentially stacked on the circumferential surface thereof.

Figure 8:
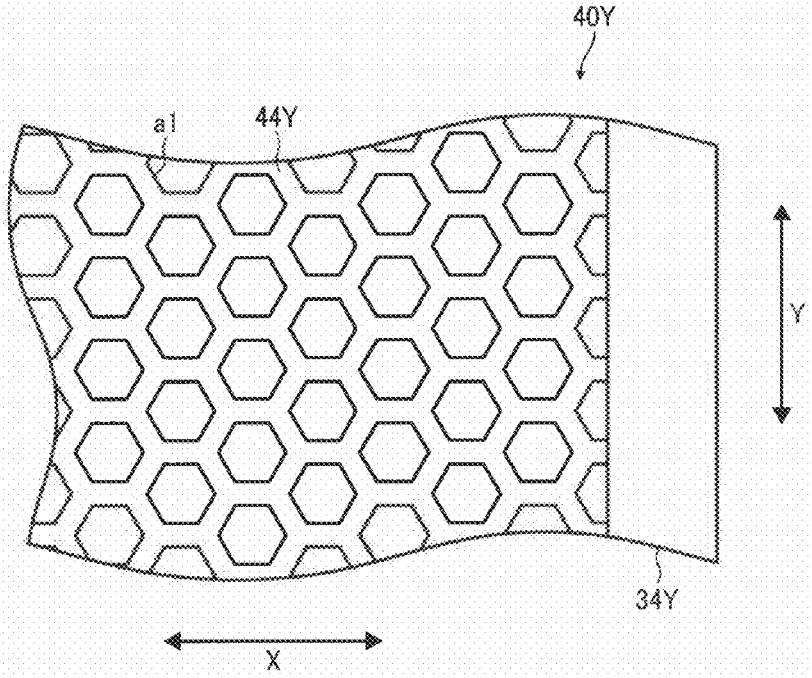
FIG. 8 is an enlarged plan view showing the one end of the roller part in the axial direction of the Y toner bearing roller in the printer related to the first embodiment of the present invention.

The first electrode layer 42Y is a film-like layer comprising a metal, such as copper, aluminum, stainless steel or the like, and is formed at a uniform thickness over the entire area of the circumferential surface of the roller body 41Y. An insulation layer 43Y comprising an insulating material such as a polyimide is laminated at a thickness of approximately 25 [μm] on top of this first electrode layer 42Y. Further, a second electrode layer 44Y comprising a metal is laminated on top of this insulation layer 43Y. As shown in FIGS. 7 and 8, the second electrode layer 44Y, which exists in an upper layer location that is closer to the surface than the first electrode layer 42Y, constitutes a honeycomb structure in which a plurality of regular hexagonal openings a1 are lined up in the form of a bees' nest. The surface layer 45Y is laminated on top of a plurality of spots between openings that are formed between the plurality of openings a1 on the second electrode layer 44Y of this configuration, and inside the plurality of openings a1.

Figure 9:
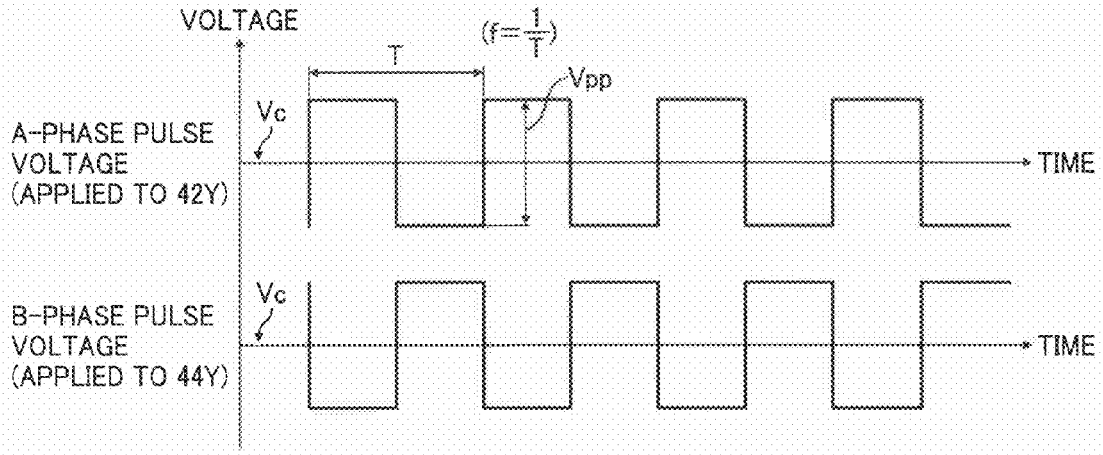
FIG. 9 is a graph showing the waveforms of pulse voltages applied to the respective electrodes of the Y toner bearing roller in the printer related to the first embodiment of the present invention.
Figure 10:
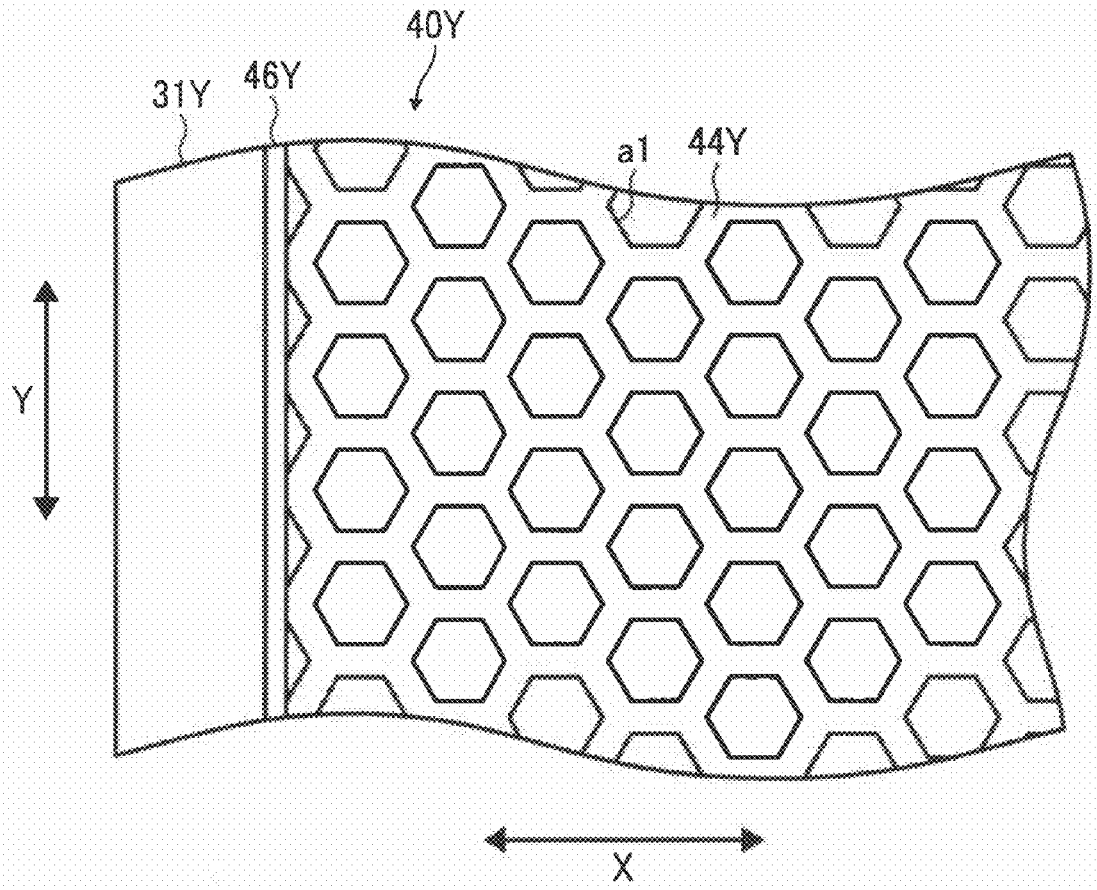
FIG. 10 is an enlarged plan view showing the other end of the roller part in the axial direction of the Y toner bearing roller in the printer related to the first embodiment of the present invention.

The one end of the second electrode layer 44Y in the roller axial direction makes press-contact with the metal second flange 34Y, which is affixed to the one end of the roller part 40Y as shown in FIG. 8. The B-phase pulse voltage shown in FIG. 9 is applied to the second electrode layer 44Y by way of this second flange 34Y. Conversely, as shown in FIG. 6 and FIG. 10, a metal first flange 31Y is affixed to the other end of the roller part 40Y in the axial direction. An insulating member 46Y like that shown in FIG. 10 is interposed between this first flange 31Y and the second electrode layer 44Y. Consequently, the insulation properties of the second electrode layer 44Y and the first flange 31Y are assured. Furthermore, the direction of arrow Y shown in FIGS. 8 and 10 is the surface movement direction of the roller part 40Y. Further, the direction of arrow X is the orthogonal-to-movement direction, that is, the direction orthogonal to the surface movement direction along the surface of the roller part 40Y. This orthogonal-to-movement direction corresponds to the direction that is orthogonal to the surface movement direction on the surface of the photosensitive belt 1. The opening a1 formation area of the second electrode layer 44Y in the orthogonal-to-movement direction of the surface of the toner bearing roller 30Y is equal to or longer than the latent image bearable area in the orthogonal-to-movement direction of the surface of the photosensitive belt 1. That is, a plurality of openings a1 can be disposed in the second electrode layer 44Y over the entire area of the latent image bearable area of the photosensitive belt 1 in the orthogonal-to-movement direction.

The first flange 31Y makes press-contact with the other end of the uniformly thick first electrode layer 42Y in the axial direction of the roller shown in FIG. 7. The A-phase pulse voltage shown in FIG. 9 is applied to the first electrode layer 42Y by way of this first flange 31Y. The A-phase pulse voltage applied to the first electrode layer 42Y and the B-phase pulse voltage applied to the second electrode layer 44Y make the pulse periods T1 appear as mutually reverse phases. The peak-to-peak voltages (Vpp) of the respective pulse voltages are identical to one another, and the center pulse voltages Vc both constitute minus polarity.

When pulse voltages like these are applied to the respective electrode layers, the toner particulates T that exist on the surface of the roller part 40Y hop as shown in FIG. 7. Specifically, the toner on the surface of the roller part 40Y hops over the entire area of the first electrode layer 42Y, and between a plurality of spots directly beneath openings that respectively exist directly beneath the plurality of openings a1 in the second electrode layer 44Y and the plurality of spots between openings that respectively exist between the plurality of openings a1 in the second electrode layer 44Y. The respective openings a1 exist on both sides of the spots between openings on the second electrode layer 44Y in the lateral direction thereof, but toner that exists directly above a spot between openings will hop randomly toward either opening a1. Further, a spot on the first electrode layer 42Y directly beneath an opening is planarity surrounded by six spots between openings that exist around an opening a1 of the second electrode layer 44Y, but toner that exists directly above a spot directly beneath an opening in the first electrode layer 42Y can randomly hop toward any of these spots between openings. Thus, a nearly uniform toner cloud is formed on the circumferential surface of the roller part 40Y over the entire area of the latent image bearable area of the photosensitive belt 1 in the orthogonal-to-movement direction (roller axial direction) by innumerable randomly hopping toner particulates.

In the second electrode layer 44Y, on which a plurality of openings a1 is disposed in a honeycomb structure matrix, a single opening a1 is surrounded by six spots between openings aligned in a regular hexagonal shape (FIG. 8). Since the plurality of spots between openings that surrounds an opening a1 like this is interconnected like a mesh, even if one spot between openings should fracture in the between-openings direction (lateral direction) due to damage, pulse voltages can continue to be supplied to all the spots between openings except this spot between openings that was fractured. Further, voltage from the surrounding spots between openings is supplied to the area in which electrode layer material remains even in a spot between openings that was fractured. Accordingly, even if one spot between openings on the second electrode layer 44Y should be fractured, toner hopping performance is favorably maintained in the locations of this fractured spot between openings where electrode layer material remains and in the other spots between openings just as if a fracture never occurred. Consequently, it is possible to suppress the generation of development defects caused by partial damage to the second electrode layer 44Y.

The first electrode layer 42Y, which exists beneath the second electrode layer 44Y, is not a configuration in which a plurality of strip-shaped electrodes are lined up as in the past, but rather constitutes an electrode layer having a large surface area with no openings that exists over practically the entire area of the surface of the roller part 40Y of the toner bearing roller 30Y. In a first electrode layer 42Y like this, even if partial damage should occur, voltage can continue to be applied to parts other than this damaged spot. Thus, even if partial damage should occur in the first electrode layer 42Y toner hopping performance can be favorably maintained in the areas excluding this damaged spot just as if the damage had never occurred. Consequently, it is possible to suppress the generation of development defects caused by partial damage to the first electrode layer 42Y.

As a result of the above, it is possible to suppress the generation of development defects caused by partial damage to an electrode layer of the roller part 40Y of the toner bearing roller 30Y.

Furthermore, an example in which pulse voltages are respectively applied to the first electrode layer 42Y and second electrode layer 44Y has been explained, but there can also be applied to either one of the electrode layers a direct current voltage of the same value as the center pulse value of the pulse voltage applied to the other electrode layer.

Further, a surface layer 45Y exists on top of the second electrode layer 44Y, and this surface layer 45Y is made from a transparent or light permeable material. Thus, as shown in FIG. 8 above, the second electrode layer 44Y that exists beneath the surface layer 45Y can be seen through the surface layer 45Y.

As described hereinabove, an insulation layer made from an insulating material is disposed between the first electrode layer 42Y and the second electrode layer 44Y. Consequently, it is possible to ensure insulation properties between the first electrode layer 42Y and the second electrode layer 44Y.

As shown in FIG. 6, the toner bearing roller 30Y has a first flange-shaft member 33Y, which is affixed to the one end of the roller part 40Y; and a second flange-shaft member 36Y, which is affixed to the other end of the roller part 40Y. The respective flange-shaft members are constituted via the integral formation of a metal flange and a shaft member. The first shaft member 32Y of the first flange-shaft member 33Y is rotatably supported by a bearing not shown in the drawing. An A-phase pulse voltage outputted from a not-shown power source is applied to the first electrode layer 42Y by way of the bearing and the first flange-shaft member 33Y. Further, the second shaft member 35Y of the second flange-shaft member 36Y is rotatably supported by a bearing not shown in the drawing. A B-phase pulse voltage outputted from the power source is applied to the second electrode layer 44Y by way of the bearing and the second flange-shaft member 36Y.

Using a toner bearing roller 30Y that has a rotatable roller part circumferential surface that is capable of endless movement as the toner bearing member, unlike the development device disclosed in Prior Art 1, makes it possible to transport hopping toner to the development area in accordance with the endless movement of the roller part circumferential surface without having to transport the development area in accordance with the hopping movement.

The opening-alignment direction sizes (inter-opening sizes) of the plurality of spots between openings, which is formed between the respective openings a1 in the honeycomb-structured second electrode layer 44Y in which a plurality of regular hexagonal openings are arranged in a matrix, are the same as one another. Consequently, it is possible to avoid variations in hopping performance resulting from different inter-opening sizes.

Figure 11:
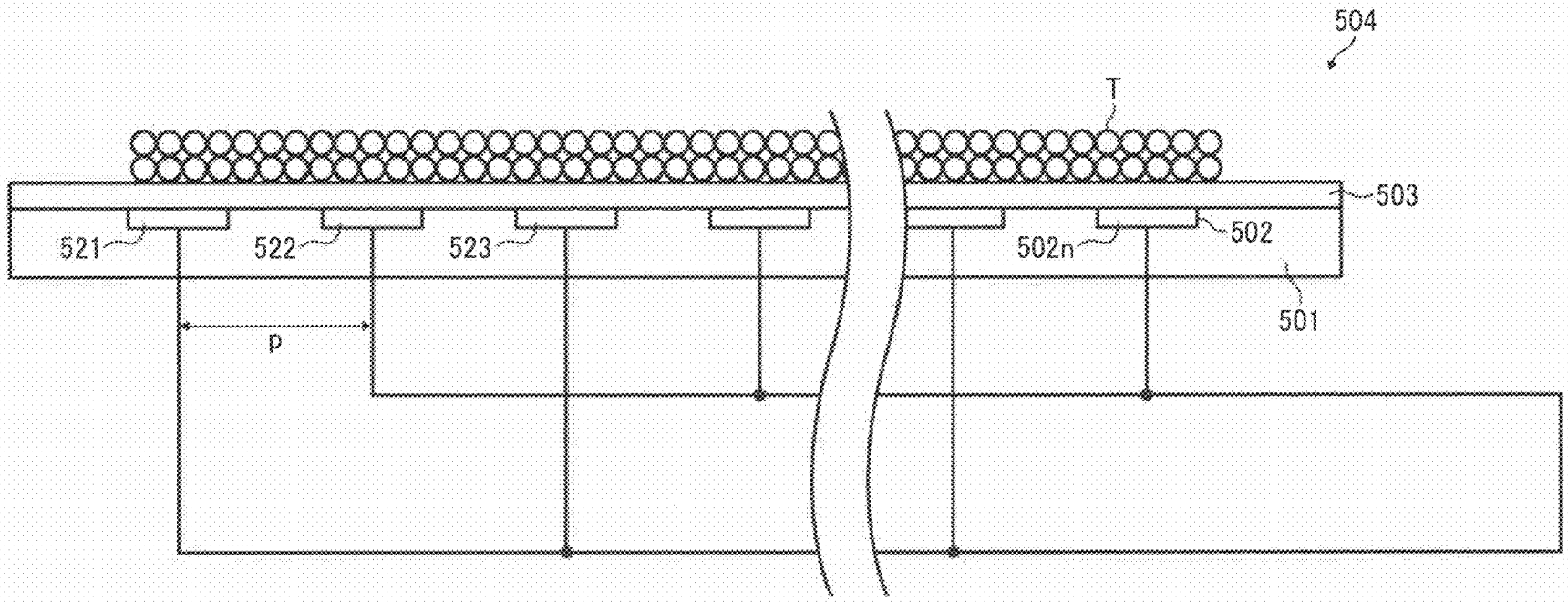
FIG. 11 is a cross-sectional view showing an experimental substrate of this embodiment.

The six inventors conducted the experiments described hereinbelow. That is, as shown in FIG. 11, a substrate that serves as a toner bearing member is configured by forming an electrode pattern 502 comprising a plurality of electrodes 521, 522, 523, . . . arranged in the direction of movement at a pitch of p[μm] by vapor depositing aluminum onto a glass substrate 501, and forming a protective layer 503 thereon by applying an approximately 3 [μm]-thick coating of resin having a volume resistivity of roughly $10^{10}$ [Q·cm], and forming a toner layer comprising charged toner particulates T on top of this substrate 504.

Figure 12:
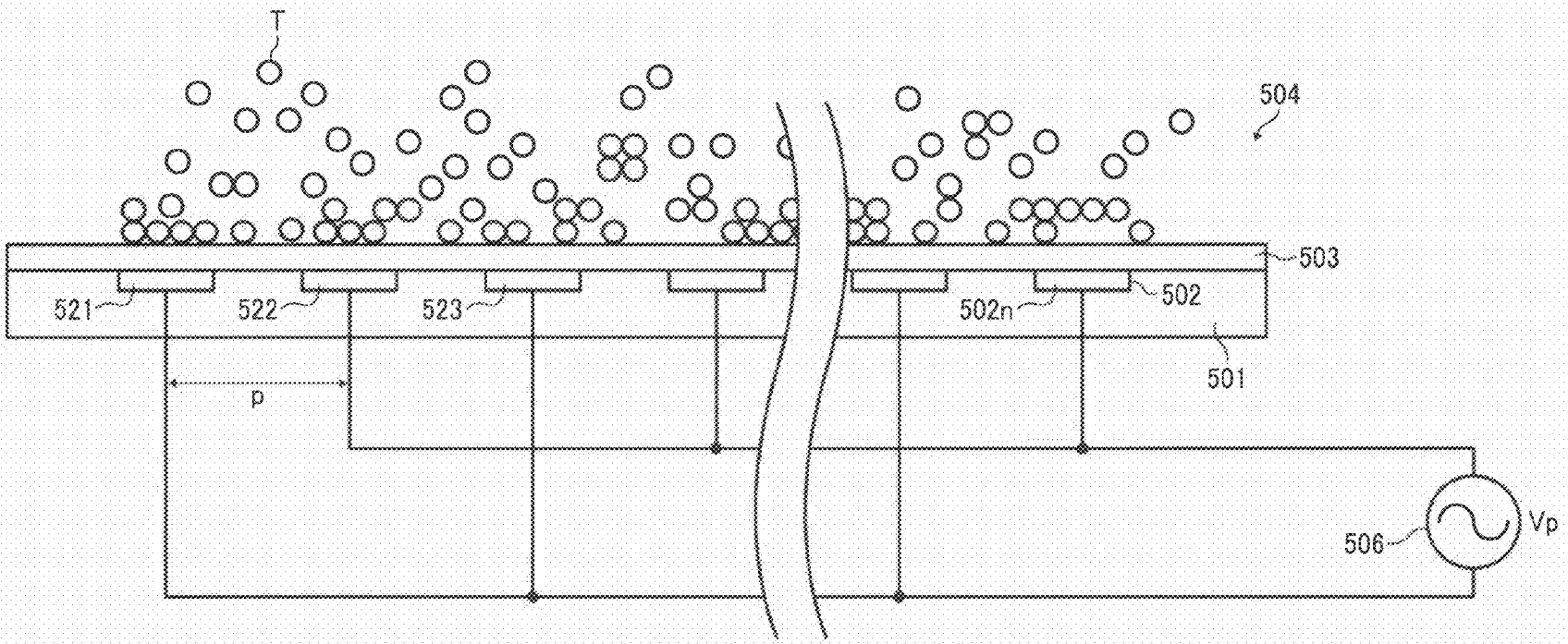
FIG. 12 is a cross-sectional view showing the flare state of the experimental substrate of this embodiment.

This toner layer forms a beta image on the substrate 504 by using a not-shown two-component development unit to develop a thin layer. A polyester toner with a grain size of approximately 6 [μm] was used, and the toner charge in the state in which the thin layer was formed on the substrate 504 was approximately −22 [μC/g]. As shown in FIG. 12, when an alternating current voltage from an alternating current power source 506 is applied to an odd-numbered electrode group, which is an aggregate of odd-numbered electrodes 521, 523, . . . , while an alternating current voltage that is the reverse phase of the above-mentioned alternating current voltage is being applied to an even-numbered electrode group, which is an aggregate of even-numbered electrodes 522, 524, . . . relative to the toner layer in this state, the toner T hops back-and-forth between the odd-numbered electrode group 521, 523, . . . and the even-numbered electrode group 522, 524, . . . . This phenomenon is called flaring (or the flare phenomenon) hereinbelow. Further, a state in which the flare phenomenon is occurring is called a flare state.

Figure 13:
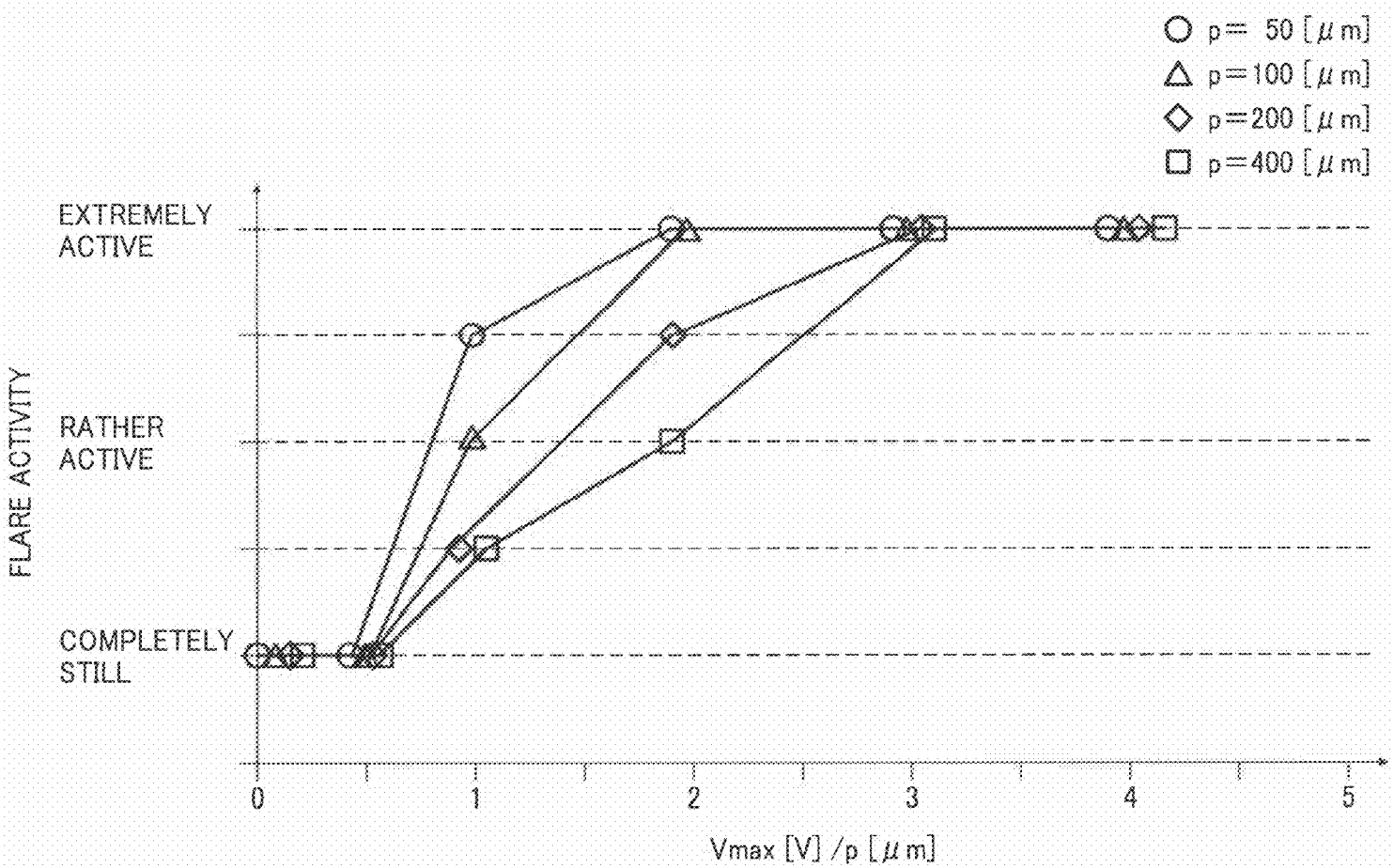
FIG. 13 is a graph showing the relationship between Vmax [V]/p[μm] and flare activity based on the results of an experiment that uses the experimental substrate of this embodiment.

Results such as those shown in FIG. 13 were obtained by using four types of substrates 504 in which the pitches of the electrodes 521, 522, 523, . . . were 50, 100, 200 and 400 [μm], respectively, and observing flare activity while varying (changing) at a number of points the Vmax[V], which is the absolute value of the difference between the plus side peak value and the minus side peak value of the alternating current voltage applied to the electrodes 521, 522, 523, . . . from the alternating current power source 506. Furthermore, the width of the electrodes 521, 522, 523, . . . and the distance to an adjacent electrode 521, 522, 523, . . . were set so as to constitute ½ of the pitch of the electrodes 521, 522, 523, . . . .

The flare activity in FIG. 13 was determined by observing the unmoving toner adhering to the surface of the substrate 504 using a five level sensory evaluation. The fact that flare activity is nearly unequivocally achieved as a result of Vmax [V]/p[μm] regardless of the values of Vmax or p can be ascertained from FIG. 13. Then, it was learned that flare activity commences when Vmax[V]/p[μm]>1, and that flare is completely activated at Vmax[V]/p[μm]>3.

Figure 14:
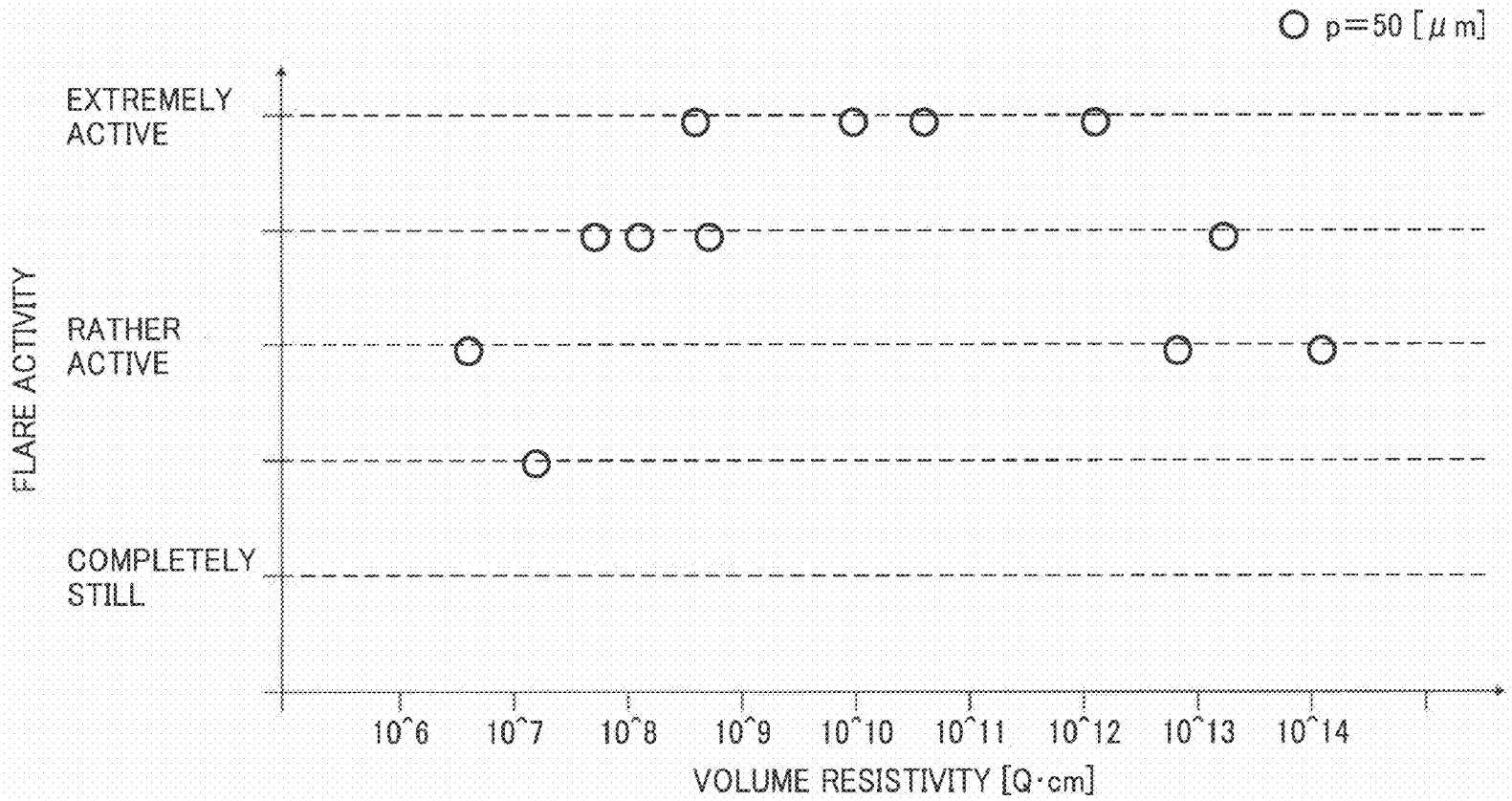
FIG. 14 is a graph showing the relationship between the specific volume resistivity of the surface layer and flare activity based on the results of an experiment that uses the experimental substrate of this embodiment.

Next, the inventors also ascertained flare activity by varying (changing) the volume resistivity of the surface layer 503 of the substrate 504 at a number of points in order to check the affects of electrical characteristics on the surface of the substrate 504. A silicon-based resin material was used in the surface layer 503, and a layer (roughly 5 [μm] thick) with volume resistivity of between $10^7$ [Ω·cm] to $10^{14}$ [Ω·cm] was formed by changing the amount of carbon particulates dispersed therein. The results shown in FIG. 14 are representative, and were obtained by using a pitch of 50 [μm] between the electrodes 521, 522, 523, . . . and conducting the same experiment as described hereinabove.

From these results, it can be ascertained that the volume resistivity of the surface layer 503 properly falls within the range of $10^9$ [Ω·cm] to $10^{12}$ [Ω·cm]. This means that the surface of the substrate 504 will become permanently charged by the friction between the repeatedly hopping toner and the surface layer 503 when using a surface layer 503 with an extremely high volume resistivity. Then, this charge changes the surface potential of the substrate 504, thereby making the bias, which contributes to development, unstable. By contrast, when the conductivity of the surface layer 503 is too high, load leakage (a short circuit) occurs between the electrodes 521, 522, 523, . . . , thus making it impossible to achieve an efficient bias effect. The surface layer 503 must have appropriate resistivity (volume resistivity of between $10^9$ [Ω·cm] to $10^{12}$ [Ω·cm]) so that the load that builds up on the surface of the substrate 504 can smoothly escape to the electrode groups 521, 522, 523, . . . . Furthermore, the optimum range of this volume resistivity was obtained via experiments using test equipment comprising the device shown in FIG. 12.

Next, to check the effects of friction charging characteristics on the surface of the substrate 504, the inventors observed flare activity the same as above using two types of surface layers 503, the one made from a silicon-based resin and the other made from a fluorine-based resin. The volume resistivity of the surface layer 503 was made between $10^{11}$ [Ω·cm] to $10^{12}$ [Ω·cm] for both the silicon-based resin and fluorine-based resin coating layers by dispersing tiny amounts of carbon particulates into these resins. When an alternating bias was applied to the electrodes 521, 522, 523, . . . from the alternating current power source 506 and flare activity was observed, the flare state continued for a long time when the surface layer 503 was the silicon-based resin, but when the surface layer 503 was the fluorine-based resin, flaring terminated immediately and the toner remained adhering to the substrate 504.

The charge of the toner on the substrate 504 was measured subsequent to the above observations, and it was learned that, whereas the charge of the toner on the substrate 504 when the surface layer 503 was the silicon-based resin only showed a slight decrease compared to initially, the charge of the toner on the substrate 504 when the surface layer 503 was the fluorine-based resin had almost completely disappeared. As a test, uncharged toner was rubbed onto the surfaces of the respective surface layers 503, and, whereas the toner achieved a regular polarity friction charge when the surface layer 503 was the silicon-based resin, when the surface layer 503 was the fluorine-based resin, not only did the toner practically not achieve any friction charge, the polarity was slightly reversed. In other words, since the flare phenomenon is a process in which the toner collides with the surface of the substrate 504 innumerable times, it was learned that it is preferable that the material for the surface layer 503 be one that can provide a normal charging polarity charge to the toner rather than one that deprives the toner of charge. This is something that can be learned from the frictional charge series of materials, and it is preferable, for example, to use a glass-based material, or a material that is used in the developer carrier coating as the surface layer 503 material.

Figure 15:
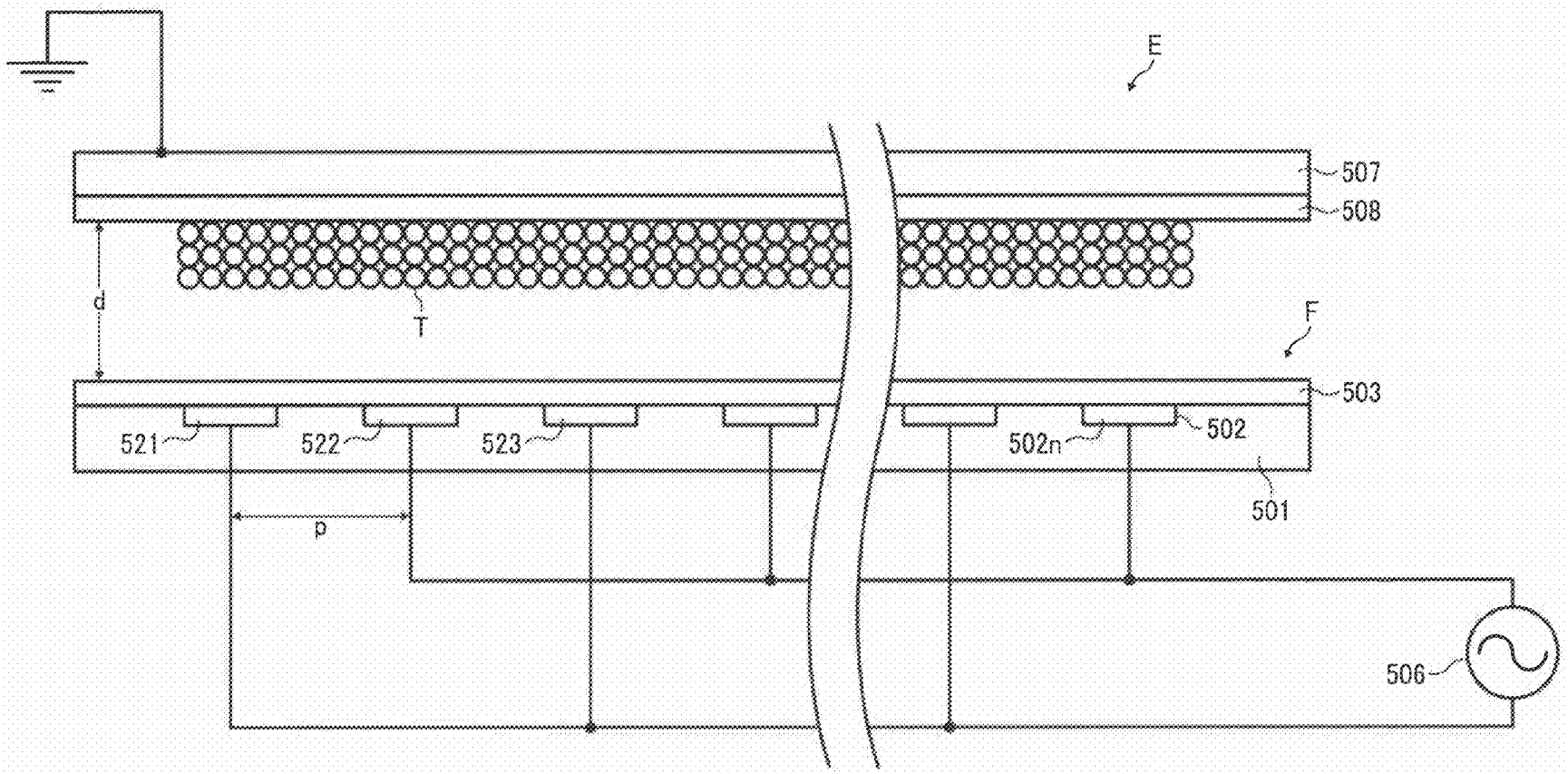
FIG. 15 is a cross-sectional view showing the approximate configuration of an experimental device of this embodiment.

Next, the inventors conducted experiments using the device shown in FIG. 15. Specifically, a substrate E is constituted by forming an approximately 20 [μm]-thick resin layer (this is assumed to be the photosensitive body) 508 on top of a substrate 507 comprising aluminum. The substrate 507 is grounded, and a toner layer of 0.4 [μg/cm$^2$] that is equivalent to a beta image is formed on the resin layer 508. This toner layer is formed by carrying out beta development for the resin layer 508 using a not-shown two-component development unit.

Figure 16:
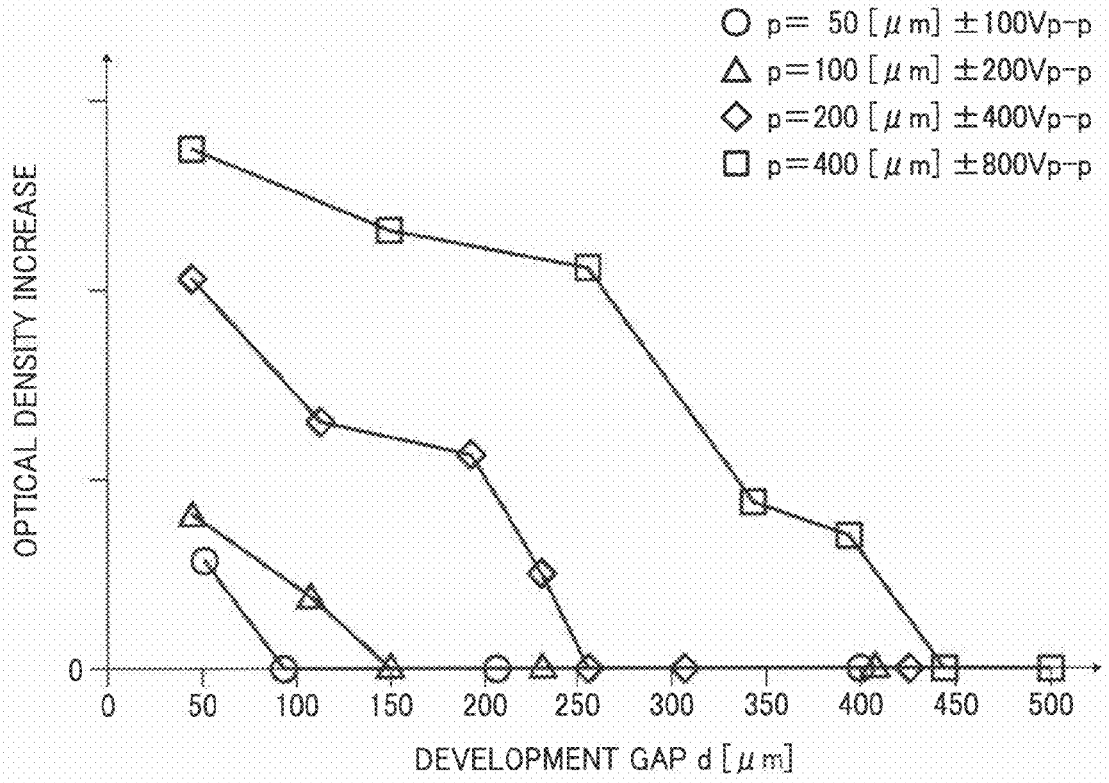
FIG. 16 is a graph showing the relationship between the development gap and the increase in optical density on a substrate A based on the results of an experiment that uses the experimental device of this embodiment.

A substrate F was installed so as to face this substrate E across a space d[μm]. This substrate F is constituted the same as substrate 504 described hereinabove, and the surface layer 503 is a white coating so as to facilitate measuring via an optical measuring device (an instrument for measuring density using reflected light) the amount of toner that is transferred here via a subsequent operation. Since it is clear from FIG. 13 that a stable flare can be formed under any conditions if Vmax[V]/p[μm]=4, the function of the development gap (d[μm]) on the amount of toner transferred to the substrate F was investigated using four types of conditions in which Vmax[V]/p[μm]=4. In so doing, results such as those shown in FIG. 16 were obtained. The vertical axis of the graph of FIG. 16 represents the increase in the optical density of the surface layer 503 of substrate F, and the optical density increase is 0 in a state in which the toner does not adhere at all to the surface layer 503. This same graph include results in which the optical density increase is larger than 0, but this is because a portion of the toner of the toner layer that had adhered to the resin layer 508 of substrate E transferred to the surface layer 503 of substrate F from the toner layer upon being subjected to the affects of the electrical field that is formed on the substrate F. When this kind of transfer occurs in superposition development, the toner of the toner layer that has been formed on the latent image bearing member (for example, the photosensitive member) during a preceding development is transferred to the inside of the subsequent color development device during subsequent development, giving rise to color mixing. Further, the image on the latent image bearing member obtained in the preceding development is corrupted. The conditions in which the optical density increase is 0 in this graph make it possible to avoid this kind of color mixing and image corruption. Then, it is clear from this graph that an inter-pitch distance p that is smaller than the development gap d, that is, $p<d$, is one such condition.

This could conceivably be a condition under which the affect of the electric field curtain formed on top of the toner bearing member (substrate F) does not reach the electrostatic latent image field or toner image on top of the latent image bearing member (substrate E). Under conditions such as this, for example, not only is it possible to accurately develop discrete dots at 1200 dpi or 2400 dpi without scavenging, but as was described hereinabove, a toner image formed on the latent image bearing member beforehand is not corrupted, and, in addition, toner color mixing does not occur inside the development device even when using an image-creating process such that toner images are superposed on top of the latent image bearing member (substrate E), thereby making it possible to realize toner image superpositioning with extremely high image quality.

The development device used to date in image-forming apparatus such as copiers, printers, facsimile machines, and so forth is a two-component development system or a one-component development system. The two-component development system is extremely well-suited to high-speed development, and is currently the mainstream device in medium- and high-speed image-forming apparatus. In this two-component development system, the developer on the part that makes contact with the electrostatic latent image on the latent image bearing member must be in an extremely dense state in order to achieve high quality. For this reason, efforts to make carrier particles smaller are currently being pushed forward, and carriers of around 30 [μm] are coming into use at the commercial level.

The one-component development system is currently the mainstream system for low-speed image forming apparatus as a result of the mechanism being compact and lightweight. In the one-component development system, the toner borne on the surface of a development roller or other such developer bearing member is used in development without being made to hop. Specifically, a blade, roller and other such toner regulating members are allowed to make contact with the toner on the development roller to form a thin layer of toner on the development roller, and the toner is electrostatically charged at this time by the friction between the development roller, toner regulating members and the toner. The charged toner layer, which is thinly formed on the development roller, is transported to the development part, and develops an electrostatic latent image on the latent image bearing member. The one-component development mode here is broadly divided into a contact type and a non-contact type, the former being a mode in which the development roller and latent image bearing member make contact with one another, and the latter being a mode in which the development roller and latent image bearing member do not make contact.

To make up for the deficiencies of the two-component development system and one-component development system, a number of hybridized systems that combine a two-component development system and a one-component development system have been proposed, as has been disclosed in Japanese Patent Laid-open No. 3-100575 (Prior Art 3).

As a method for developing tiny, uniform, high-resolution dots, for example, there is the system disclosed in Japanese Patent Laid-open No. 3-113474 (Prior Art 4). In contrast to the above-mentioned hybridized system, this system creates a toner cloud in the development part and realizes the developability of high-resolution dots by installing a wire that applies a high-frequency bias to the development part.

Further, Japanese Patent Laid-open No. 3-21967 (Prior Art 5) proposes a method for forming an electric field curtain on a rotating roller to form the most efficient and stable toner cloud.

Further, Japanese Patent Laid-open No. 2003-15419 (Prior Art 6) discloses a development device that transports the developer via an electric field curtain in accordance with a traveling wave field. Further, Japanese Patent Laid-open No. 9-269661 (Prior Art 7) discloses a development device having a plurality of magnetic poles, which nearly uniformly clamps nearly one layer of carrier to the circumferential surface of the development roller. Further, Japanese Patent Laid-open No. 2003-84560 (Prior Art 8) discloses a development device that disposes via an insulating part a periodic conductive electrode pattern on the surface of the developer bearing member, which bears a non-magnetic toner, generates an electric field gradient in the vicinity of the surface of the developer bearing member by applying a prescribed bias potential to these electrodes, thereby adhering and transporting the above-mentioned non-magnetic toner on the above-mentioned developer bearing member.

The demand for high image quality is becoming increasingly higher for the conventional two-component development system, and the required pixel dot size itself must be either the same or smaller than the diameter of the current carrier particles. Therefore, from the standpoint of discrete dot reproducibility, carrier particles must be made even smaller. However, as the size of the carrier is made smaller, the magnetic permeability of the carrier particles declines, increasing the likelihood that the carrier will separate from the development roller. When the separated carrier particles adhere to the latent image bearing member, not only does the carrier adherence itself give rise to image defects, but various other side effects also occur as a result of this, such as damage to the latent image bearing member.

To prevent this carrier separation, attempts are being pushed forward on the material side to raise the magnetic permeability of the carrier particles, and efforts are also being made to strengthen the magnetic force of the magnet embedded inside the development roller, but the need to reduce costs while raising image quality is making development extremely difficult. Further, as the diameter of the development roller becomes increasingly smaller in response to the trend toward miniaturization, it is becoming difficult to design a development roller that has a magnetic field configuration powerful enough to completely suppress carrier separation.

To begin with, since the two-component development system is a process that forms a toner image by rubbing the ears of the two-component developer, called the magnetic brush, against the electrostatic latent image, the unevenness of the ears inevitably gives rise to irregularities in the developability of discrete dots. It is possible to enhance image quality by forming alternating electric fields between the development roller and the latent image bearing member, but it is difficult to completely do away with basic image irregularities, such as the irregularities of the ears of the developer.

Further, in order to enhance transfer efficiency and cleaning efficiency in the step for transferring a toner image that has been developed on the latent image bearing member, and the step for cleaning the residual toner left on the latent image bearing member subsequent to transfer, the non-electrostatic adhesion between the latent image bearing member and the toner must be reduced as much as possible. As a method for lowering the non-electrostatic adhesion between the latent image bearing member and the toner, reducing the friction coefficient of the surface of the latent image bearing member is known to be effective, but, since the ears of the two-component developer slip smoothly through the development part in this case, development efficiency and dot reproducibility become extremely poor.

In the one-component development system, a layer of toner on the development roller that has been thinned by the toner regulating members makes full press-contact with the development roller, thereby causing the toner responsiveness to the electric field of the development part to become extremely poor. Accordingly, ordinarily, in order to achieve high image quality, the mainstream approach is to form a powerful alternating electric field between the development roller and the latent image bearing member, but even with the formation of this alternating electric field, it is difficult to stably develop a fixed amount of toner for an electrostatic latent image, and it is difficult to uniformly develop a tiny, high-resolution dot. Further, since the one-component development system applies an extremely high stress to the toner when forming the thin layer of toner on the development roller, the toner circulating inside the development device deteriorates extremely rapidly. In line with the deterioration of the toner, irregularities and the like become more likely even in the step for forming the thin layer of toner on the development roller, making the one-component development system unsuitable for high-speed or high-durability image forming apparatus.

A hybridized system (the above-mentioned Prior Art 3) overcomes a number of problems even though the size and number of parts of the development device itself increase. However, in the end, the development part is still faced with the same problem as in the one-component development system, that is, developing a tiny, uniform, high-resolution dot is still difficult.

It is conceivable that the system disclosed in the above-mentioned Prior Art 4 is able to realize highly stable, high image quality development, but the development device configuration is complex.

Further, the system disclosed in the above-mentioned Prior Art 5 can be interpreted as being extremely good at achieving compact size and high image quality development, but as a result of the diligent research of the inventors, it was discovered that the conditions for development and the electric field curtain that is formed must be strictly limited in order to achieve ideal high image quality. That is, if image creation is carried out using a condition that strays from the appropriate condition, not only is the effectiveness of this system completely lost, but inferior image quality also results. Further, this system is such that the toner that is hopping on top of the toner bearing member is transported to the development area by the surface movement of the toner bearing member, but the same can be said about the system disclosed in the above-mentioned Prior Art 1, which transports the toner to the development area in accordance with the hopping motion of the toner alone without causing the surface of the toner bearing member to move.

Further, in an image creation process such that a first toner image is formed on the latent image bearing member, and a second toner image and third toner image are formed in order thereon, the development system must be one that does not corrupt the toner image first formed on the latent image bearing member. It is possible to sequentially form toners of respective colors on the latent image bearing member by using a non-contact one-component development system or the toner cloud development system disclosed in the above-mentioned Prior Art 4, but since an alternating electric field is formed between the latent image bearing member and the development roller in both systems, a portion of the toner is pulled away from the toner image first formed on the latent image bearing member, and enters the development device. Consequently, not only is the image on the latent image bearing member corrupted, but there also arises the problem of different colored toners being mixed together inside the development device. It is crucial that these systems achieve high quality images, and to solve for this problem will require a method that realizes toner cloud development without forming an alternating electric field between the latent image bearing member and the development roller.

As a method that is capable of realizing toner cloud development like this, it is conceivable that the systems disclosed in the above-mentioned Prior Art 1 and Prior Art 5 are effective, but as stated hereinabove, these systems are completely ineffective unless used under the appropriate conditions. Specifically, when the conditions are not proper, it becomes impossible to make a toner cloud. Furthermore, even if a toner cloud is made, in superposition development, the toner in the latent image bearing member toner layer that was obtained in the preceding development will migrate inside the development device of the subsequent color, giving rise to image corruption and color mixing.

Accordingly, with the results of the above-described experiments in view, the printer related to this first embodiment satisfies the condition $V_{max}[V]/p[\mu m]>1$. This configuration makes it possible to reliably create a toner cloud. Accordingly, in accordance with this first embodiment, it is possible to realize higher image quality and more compactness than in the prior art.

Furthermore, even in a method in which the mechanical driving of the toner bearing member is eliminated and the toner is electrostatically transported and developed by an alternating field of three or more phases as in the system disclosed in the above-mentioned Prior Art 1, it is conceivable that requiring that the above-mentioned condition be satisfied will make it possible to reliably create a toner cloud. However, The problem with the method disclosed in this prior art is that toner that can no longer be electrostatically transported for one reason or another accumulates on the transport substrate with the result that the transport substrate ceases to function. To solve for this problem, for example, a structure that combines a fixed transport substrate with a toner bearing member that moves on the surface thereof like the system disclosed in Japanese Patent Laid-open No. 2004-286837 (referred to hereinafter as Prior Art 9) has also been proposed, but the mechanism is extremely complex. By contrast, in a system like this printer in which the toner is transported to the development area by the surface movement of the toner bearing member while hopping back and forth between electrodes, it is possible to avoid the toner buildup and the complex mechanism described hereinabove.

Figure 17A:
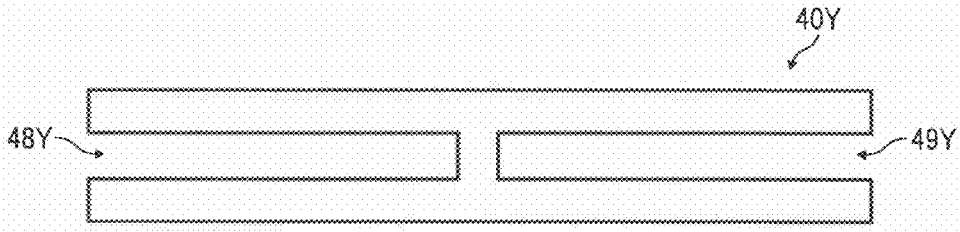
FIG. 17A is a vertical cross-sectional view showing the roller part of the experimental device of this embodiment.
Figure 17B:
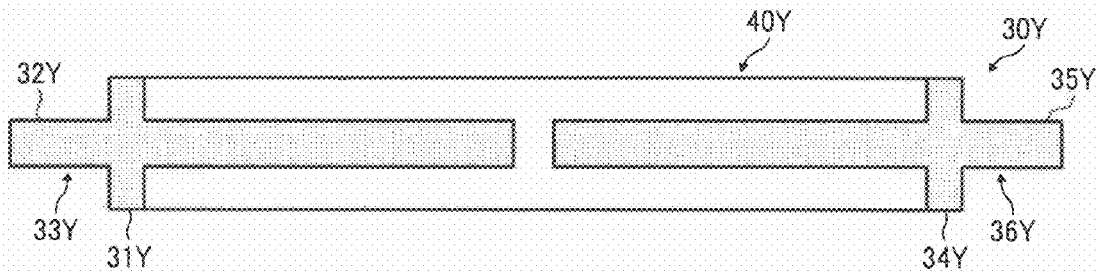
FIG. 17B is a vertical cross-sectional view showing the toner bearing roller of the experimental device of this embodiment.
Figure 17C:
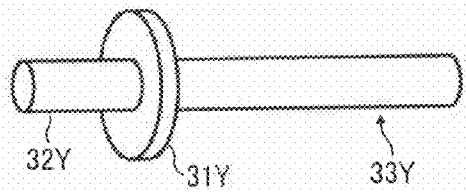
FIG. 17C is an oblique view showing the exterior of a first flange-shaft member of the toner bearing roller of the experimental device of this embodiment.

Referring to FIG. 17A of the drawing, there is a vertical cross-sectional view showing the roller part 40Y. Further, FIG. 17B is a vertical cross-sectional view showing the toner bearing roller 30Y. Further, FIG. 17C is an oblique view showing the first flange-shaft member 33Y. The roller part 40Y, as shown in FIG. 17A, has a shaft hole 48Y extending toward the center from the one end in the roller axial direction in the circular center of a cylindrical roller body of acrylic resin. Further, the roller part 40Y has a shaft hole 49Y extending toward the center from the other end in the roller axial direction. The first shaft member 32Y of the first flange-shaft member 33Y, which is affixed to the one end of the roller part 40Y in the axial direction, protrudes respectively from both ends of the first flange 31Y. Then, the one protruding shaft, as shown in FIG. 17B, is inserted and fitted into the shaft hole 48Y of the roller part 40Y as shown in FIG. 17B, and the first flange-shaft member 33Y is thereby affixed to the one end of the roller part 40Y. The second flange-shaft member 36Y is similarly affixed to the other end of the roller part 40Y.

In FIG. 9 shown above, the A-phase pulse voltage and the B-phase pulse voltage have the same Vpp value, center pulse voltage Vc and cycle, and, in addition, the pulse generation phases thereof constitute a reverse phase relationship. In a relationship like this, the sum of the two pulse voltages is treated as the center pulse voltage Vc regardless of the elapsed time (regardless of the phase). Then, in this first embodiment, the center pulse voltage Vc constitutes a value between the potential of the background portion (uniform charging potential) of the photosensitive belt 1 and the latent image potential. In a configuration like this, toner hopping on the surface of the toner bearing roller 30Y can reliably be made to adhere to an electrostatic latent image by the potential difference of the sum of the two pulse voltages and the latent image potential (image part potential). Further, the potential difference between the sum of the two pulse voltages and the background portion potential (non-image part potential) can reliably prevent the adherence of the toner to the background portion (scumming). Furthermore, the uniform charging potential of the photosensitive belt 1 is between −300 to −500 [V]. Further, the latent image potential is between 0 and −50 [V]. Then, the center pulse potential is between −100 and −200 [V]. As one example of an A-phase pulse voltage and a B-phase pulse voltage, an example of a AC-load DC-bias can be given in which the peaks of the respective pulse voltages are −400 [V] and 0 [V], the center pulse potential is −200 [V], and the frequency is 5 [kHz].

The toner comprises either polyester or styrene acrylic as the base resin (main ingredient of the toner), and, in addition, the normal charging polarity is minus polarity (negative polarity). Then, there is performed a so-called reversal phenomenon, in which the uniform charging part (background portion) of the photosensitive belt 1 and the electrostatic latent image are both made the same polarity as the normal charging polarity of the toner (in this example, minus polarity), and, in addition, the toner is caused to selectively adhere to the electrostatic latent image, the potential of which has been attenuated more than that of the background portion.

The surface layer 45Y comprises a material that supports a frictional charge to the toner normal charging polarity side (in this case, the minus side) in line with slidingly rubbing against the toner that is hopping thereon. That is, the toner is located more on the minus side of the frictional charging series than the surface layer 45Y. Organic materials, such as silicone, nylon, melamine resin, acrylic resin, PVA, urethane and the like can be cited as example of surface layer 45Y materials that are capable of realizing this kind of relationship. Further, a quaternary ammonium salt or nigrosin-based dye can also be used. Further, Ti, Sn, Fe, Cu, Cr, Ni, Zn, Mg, Al and other such metal materials can be used. Further, inorganic materials, such as $TiO_2$, $SnO_2$, $Fe_2O_3$, $Fe_3O_4$, CuO, $Cr_2O_3$, NiO, ZnO, MgO, and $Al_2O_3$ can also be used. Furthermore, a material that mixes together two or more of the materials given as examples up to this point can also be used.

In this printer, which comprises this kind of surface layer 45Y, the surface layer 45Y supports a frictional charge to the toner normal charging polarity side in line with slidingly rubbing against the hopping toner. Consequently, it is possible to suppress the generation of development defects resulting from toner hopping defects by curbing a drop in the toner charge (normal charging polarity) accompanying hopping.

Furthermore, a material having a plus polarity (positive polarity) as the normal charging polarity can also be used as the toner. In this case, the surface layer 45Y can comprise a material that supports a frictional charge to the toner plus polarity side in line with slidingly rubbing against the toner.

Further, the toner charging series signifies the charging series of the entire toner to which an external additive like silica or titanium oxide has been added to the toner base resin (particles). The rank order for the charging series can be checked as follows. That is, after the toner on the surface layer 45Y has been slidingly rubbing against the surface layer 45Y for a prescribed period of time, this toner is extracted by being suctioned off. Then, the charge of the extracted toner is measured using an electrometer. If the result of this measurement indicates an increase in the charge to the negative polarity of the toner, the toner is a charging series that is more on the minus side than the surface layer 45Y. Further, if the measurement result indicates an increase in the charge to the positive polarity of the toner, the toner is a charging series that is more on the plus side than the surface layer 45Y.

The Y toner bearing roller 30Y has been explained, and the other color toner bearing rollers 30M, 30C, 30K constitute the same configuration as that for Y.

Next, respective modifications of the printer related to the first embodiment will be explained. Furthermore, unless specifically noted otherwise below, the configuration of the printers related to the respective modifications will be the same as in the first embodiment.

First Modification

In a printer related to a first modification, the toner bearing rollers 30Y, 30M, 30C, 30K are not provided with a first flange-shaft member or a second flange-shaft member. Acrylic resin shaft members that are integrally formed to the roller body respectively protrude from both ends of the roller part (for example 40Y) of the toner bearing rollers 30Y, 30M, 30C, 30K in the axial direction, and these shaft members are rotatably supported by not-shown bearings.

Using the Y toner bearing roller 30Y as an example, the first electrode layer 42Y of this roller part 40Y is a layer of uniform thickness that extends over the entire roller part 40Y regardless of the location in the axial direction of the roller. Further, an insulation layer 43Y, second electrode layer 44Y and surface layer 45Y are not formed on the first electrode layer 42Y at one end thereof in the axial direction of the roller, thereby the first electrode layer 42Y is exposed in a ring shape over the entire circumference in the circumferential direction of the roller. A first contact electrode that is affixed to the printer main unit makes contact with this ring-shaped exposed area. When the roller part 40Y rotates, the affixed first contact electrode slidingly rubs against the ring-shaped exposed area of the first electrode layer 42Y on the roller part 40Y. An A-phase pulse voltage is applied to the first electrode layer 42Y by way of this first contact electrode.

The second electrode layer 44Y of this roller part 40Y constitutes a ring-shaped form that extends over the entire circumference of the roller in the circumferential direction at the other end of this roller in the axial direction without an opening a1. Then, a ring shape that extends around the entire circumference of the roller in the circumferential direction is exposed on this other end without a surface layer 45Y being formed. A second contact electrode that is affixed to the printer main unit makes contact with this ring-shaped exposed area. When the roller part 40Y rotates, the affixed second contact electrode slidingly rubs against the ring-shaped exposed area of the second electrode layer 44Y on the roller part 40Y. A B-phase pulse voltage is applied to the second electrode layer 44Y by way of this second contact electrode.

Second Modification

Figure 18:
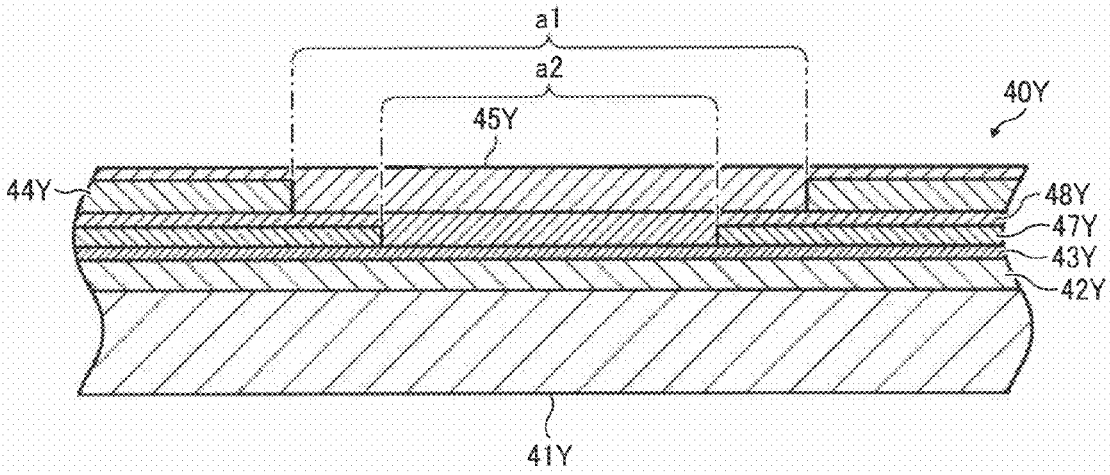
FIG. 18 is an enlarged cross-sectional view showing the roller part of the Y toner bearing roller of a printer related to a second modification of this embodiment.
Figure 19:
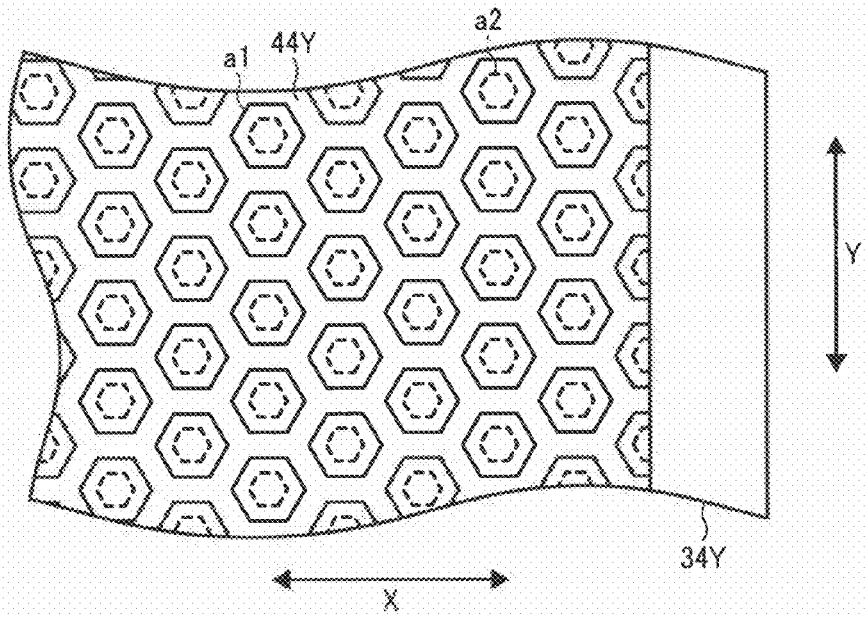
FIG. 19 is an enlarged plan view showing the one end of the roller part in the axial direction of the Y toner bearing roller of a printer related to a second modification of this embodiment.

Referring to FIG. 18 of the drawings, there is an enlarged cross-sectional view showing the roller part 40Y of the Y toner bearing roller of a printer related to a second modification. Referring to FIG. 19 of the drawings, there is an enlarged plan view showing the one end of the roller part 40Y in the axial direction. In FIG. 18, an insulation layer 43Y, a shield electrode layer 47Y and a second insulation layer 48Y are interposed between the first electrode layer 42Y and the second electrode layer 44Y. Specifically, an insulation layer 43Y of uniform thickness is laminated over the entire surface of the first electrode layer 42Y. Then, a shield electrode 47Y comprising a metal material is laminated on top of this insulation layer 43Y. This shield electrode layer 47Y, as shown in FIG. 19, has a plurality of openings a2 respectively corresponding to the individual openings a1 in the second electrode layer 44Y. The individual openings a2 of the shield electrode 47Y are hexagonal shapes of smaller diameters than the openings a1 of the second electrode layer 44Y, and are located directly beneath the openings a1 of the second electrode layer 44Y. Consequently, a plurality of spots directly beneath openings opposite the surface layer 45Y is formed on the first electrode layer 42Y by way of the shield electrode layer 47Y openings a2 and the second electrode layer 44Y openings a1. A second insulation layer 48Y, which comprises an insulating material, is laminated on top of the non-opening areas and inside the openings a2 of the shield electrode layer 47Y, and a second electrode layer 44Y and surface layer 45Y the same as in the first embodiment are laminated on top thereof.

Third Modification

Figure 20:
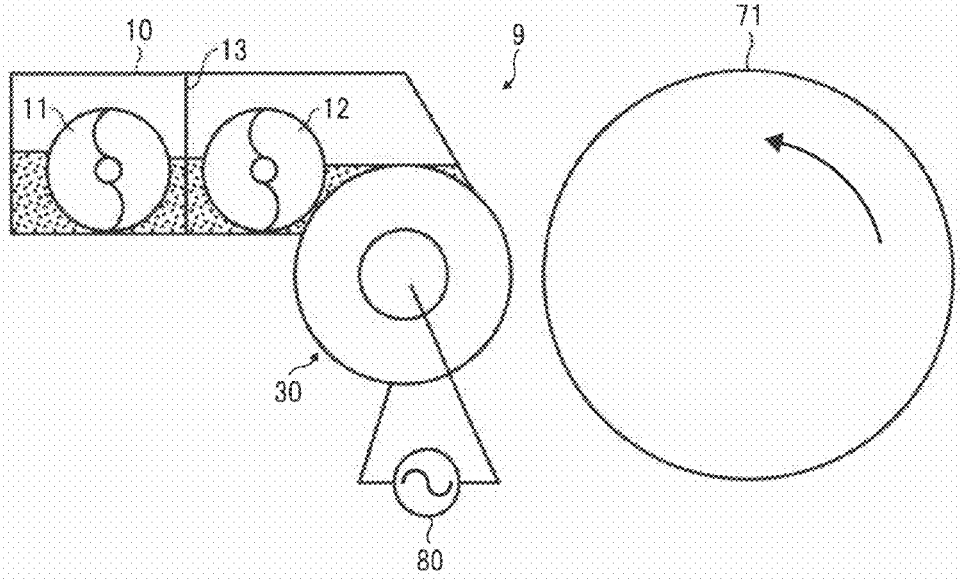
FIG. 20 is a diagram showing a rough configuration of a printer related to a third modification of this embodiment.

Referring to FIG. 20 of the drawings, there is a diagram showing an approximate configuration of a printer related to a third modification. This printer uses a single development device 9 to form a monochromatic image. The latent image bearing member comprises a drum-shaped photosensitive body 71. The developer hopper 10 does not have a rotating sleeve, and a portion of the circumferential surface of the toner bearing roller 30 enters inside the second chamber of the developer hopper 10 through an opening in the hopper casing. The developer hopper 10 makes use of cascading to form a thin toner layer on the surface of the toner bearing roller 30. The rate of toner transfer to the toner bearing roller 30 is lower than that of the first embodiment, but raising the rotation speed of the toner bearing roller 30 to that extent makes it possible to achieve the same toner feeding performance as in the first embodiment.

Fourth Modification

Figure 21:
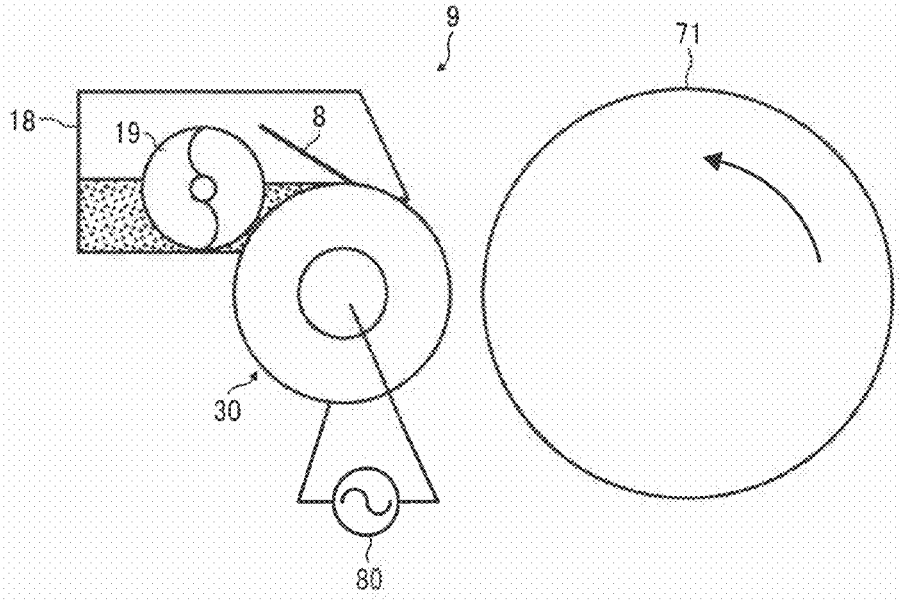
FIG. 21 is a diagram showing an approximate configuration of a printer related to a fourth modification of this embodiment.

Referring to FIG. 21 of the drawings, there is a diagram showing an approximate configuration of a printer related to a fourth modification. Instead of a developer hopper, the development device 9 of the printer shown in the drawing has a toner hopper 18, and toner is stored inside thereof. An opening is disposed in the toner hopper 18 casing, and a portion of the circumferential surface of the toner bearing roller 30 enters inside the toner hopper 18 through this opening. The toner inside the hopper rides on the surface of the toner bearing roller 30 inside the toner hopper 18. When the toner bearing roller 30 rotates, a thin toner layer is formed on the surface of the toner bearing roller 30. A rotatable agitator 19 inside the toner hopper 18 transports the toner to the surface of the toner bearing roller 30 so as to place a sufficient amount of toner on top of the surface of the toner bearing roller 30. The thickness of the thin toner layer that is formed on the surface of the toner bearing roller 30 is regulated by a metering blade 8 prior to exiting the toner hopper 18 in line with the rotation of the roller.

Next, a printer of a second embodiment that applies the present invention will be explained. Furthermore, unless specifically stated otherwise hereinbelow, the configuration of the printer related to the second embodiment is the same as that of the first embodiment.

The printer related to the second embodiment respectively comprises Y, M, C and K toner bearing rollers, but these toner bearing rollers, unlike those of the first embodiment, are affixed so as to be unable to rotate. The constitution is such that the toner borne on the circumferential surface of the toner bearing roller repeatedly hops in one direction, either in the right-hand direction or in the left-hand direction, on top of the circumferential surface.

Figure 22:
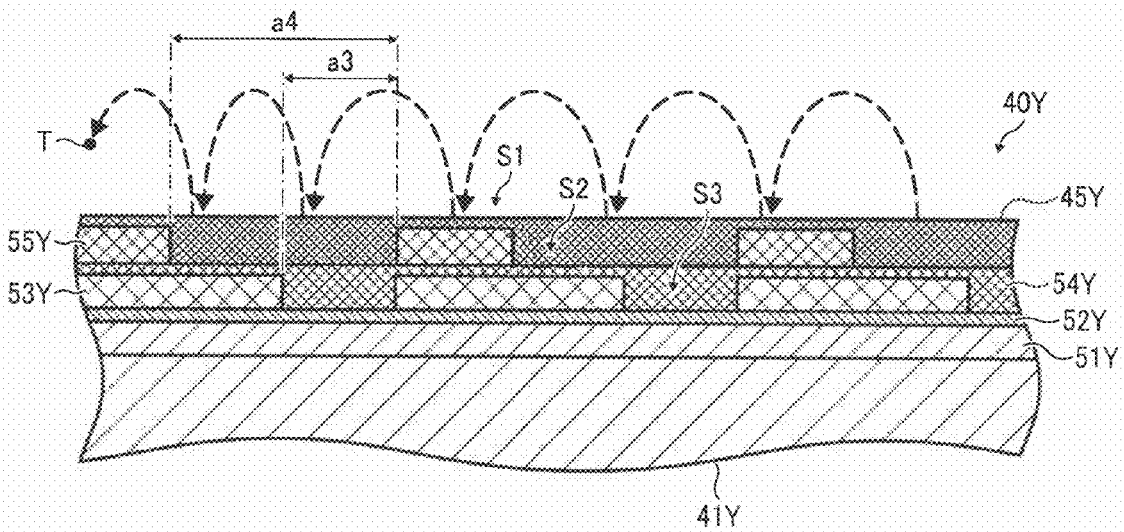
FIG. 22 is a cross-sectional view showing the roller part of the Y toner bearing roller of a printer related to a second embodiment of the present invention.

Referring to FIG. 22 of the drawings, the roller part 40Y in the Y toner bearing roller of the printer related to the second embodiment is shown. In this drawing, a lowermost electrode layer 51Y covers at a uniform thickness the entire area of the circumferential surface of a roller body 41Y comprising an insulating material. Further, an insulation layer 52Y comprising an insulating material is laminated at a uniform thickness on top of the lowermost electrode layer 51Y. Furthermore, an intermediate electrode layer 53Y is laminated on top of this insulation layer 52Y. This intermediate electrode layer 53Y has a plurality of openings a3, which line up in the direction of movement of the toner resulting from repeated hopping, and these openings a3 constitute rectangular shapes that extend in the orthogonal-to-movement direction, which is orthogonal to the direction of movement of the toner. These openings a3 extend in the direction orthogonal to the surface of the paper on which the drawing is drawn. The length of these openings a3 in the direction of extension (longitudinal direction) is equal to or greater than the latent image bearable area in the width direction of a photosensitive belt.

An insulation layer 54Y comprising an insulating material is laminated on top of the spots between openings and inside the openings a3 of the intermediate electrode layer 53Y. Further, an uppermost electrode layer 55Y is laminated on top of this insulation layer 54Y. Similar to the intermediate electrode layer 53Y, this uppermost electrode layer 55Y also has a plurality of openings a4, which line up in the direction of movement of the toner resulting from repeated hopping, and these openings a4 also constitute rectangular shapes that extend in the orthogonal-to-movement direction, which is orthogonal to the direction of movement of the toner. The length of these openings a4 in the direction of extension (longitudinal direction) is the same as the length of the openings a3 of the media electrode layer 53Y.

A surface layer 45Y the same as that of the first embodiment is laminated on top of the spots between openings and inside the openings a4 of the uppermost electrode layer 55Y.

The length in the lateral direction (the toner movement direction) of the plurality of openings a4 of the uppermost electrode layer 55Y is approximately two times that of the lateral direction of the openings a3 of the intermediate electrode layer 53Y. Further, the number of openings a4 in the uppermost electrode layer 55Y is the same as the number of openings a3 in the intermediate electrode layer 53Y. Then, the constitution is such that the plurality of openings a4 of the uppermost electrode layer 55Y and the plurality of openings a3 of the intermediate electrode layer 53Y oppose one another in the lamination direction in a one-to-one relationship, and in a lamination direction projection image, roughly one half of the lateral-direction length of the openings a4 of the uppermost electrode layer 55Y overlap nearly the entire area of the intermediate electrode layer 53Y.

When the roller part 40Y is viewed from the surface side, a strip-shaped (rectangular shaped) spot S3 of the lowermost electrode layer 51Y directly beneath the opposing openings can be seen through these openings in an area in which an opening a4 of the uppermost electrode layer 55Y and an opening a3 of the intermediate electrode layer 53Y are opposite one another. Further, a strip-shaped spot S2 of the intermediate electrode layer 53Y directly beneath an opening can be seen through an opening a4 of the uppermost electrode layer 55Y on the lateral-direction side of the opening of this spot S3 directly beneath the opposing openings. Further, a spot S1 between the openings in the uppermost electrode layer 55Y can be seen in the lateral direction side of the opening of this spot S2 directly beneath an opening. The strip-shaped spot S2 in the intermediate electrode layer 53Y directly beneath an opening or the strip-shaped spot S3 of the lowermost electrode layer 51Y directly beneath opposing openings constitutes the same size as a strip-shaped electrode in a conventional development device.

The lowermost electrode layer 51Y, intermediate electrode layer 53Y and uppermost electrode layer 55Y have the same Vpp as one another, and, in addition, are applied with phase-shifted A-phase pulse voltage, B-phase pulse voltage and C-phase pulse voltage. In so doing, the toner particles T that exist directly above the spot S3 in the lowermost electrode layer 51Y directly beneath opposing openings hops on the surface of the roller part 40Y as indicated by the dotted-line arrows in the drawing. Then, the toner particles T move to directly above the spot S2 in the intermediate electrode layer 53Y directly beneath an opening. Next, the toner particles T hop from directly above the spot S2 directly beneath an opening, move to directly above the spot S1 between openings of the uppermost electrode layer 55Y, and thereafter, hop yet again to move directly above the spot S3 in the lowermost electrode layer 51Y directly beneath opposing openings. By repeating this series of hopping, the toner particles T move from the right to the left in the drawing, finally reaching the development area.

The lowermost electrode layer 51Y, which does not need to provide a plurality of openings, can be an electrode layer having a large surface area that covers nearly the entire area of the surface of the roller part 40Y the same as the first electrode layer of the printer related to the first embodiment. Thus, even if partial damage should occur in the lowermost electrode layer 51Y, toner hopping performance can be favorably maintained in the areas excluding this damaged spot the same as if the damage had never occurred. Consequently, it is possible to suppress the generation of development defects caused by partial damage to the lowermost electrode layer 51Y.

The intermediate electrode layer 53Y has non-opening spots on both sides of its own openings a3 in the direction of extension (longitudinal direction). Both of these non-opening spots extend in the direction of movement of the toner resulting from repeated hopping, and either one of the non-opening spots is connected from the one end in the direction of extension of the respective openings relative to the plurality of spots S2 directly beneath openings lined up in the direction of movement of the toner. Further, the other non-opening spot is connected from the other end in the direction of extension of the openings relative to the plurality of spots S2 directly beneath openings. In this intermediate electrode layer 53Y, even if any one of the plurality of spots S2 directly beneath openings having the same function as the conventional strip-shaped electrode should fracture in the lateral direction due to partial damage, voltage can be supplied to this spot S2 directly beneath the opening from both sides in the opening extension direction bordering on the fractured area. Accordingly, even if any one of the spots S2 directly beneath an opening in the intermediate electrode layer 53Y is fractured, the spot S2 directly beneath this opening will favorably maintain toner hopping performance the same as when there was no fracture. Consequently, it is also possible to suppress the generation of development defects caused by partial damage to the intermediate electrode layer 53Y.

In the uppermost electrode layer 55Y, even if any one of the plurality of spots S1 between openings having the same function as the conventional strip-shaped electrode should fracture in the lateral direction due to partial damage, for the same reason as the intermediate electrode layer 53Y, voltage can be supplied to this spot S1 between openings from both sides in the opening extension direction bordering on the fractured area. Accordingly, even if any one of the spots S1 between openings in the uppermost electrode layer 55Y is fractured, this spot S1 between openings will favorably maintain toner hopping performance the same as when there was no fracture. Consequently, it is also possible to suppress the generation of development defects caused by partial damage to the uppermost electrode layer 55Y.

Furthermore, two or more intermediate electrode layers can be disposed between the uppermost electrode layer 55Y and the lowermost electrode layer 51Y, and phase-shifted pulse voltages can be mutually applied to each of the respective electrode layers. In this case, the lengths of the openings in the respective electrode layers in the lateral direction can gradually be made smaller from the upper layers toward the lower layers, and all of the electrode layer openings can be opposed to one another.

In the printer related to the first embodiment above, since an insulation layer 43Y comprising an insulating material is disposed between the first electrode layer 42Y and the second electrode layer 44Y, the insulating properties of the two electrode layers can be assured by the insulation layer 43Y.

Further, in the printer related to the first embodiment, a toner bearing roller, which provides a circumferential surface that is capable of endless movement in accordance with rotation, is used as the toner bearing member. In a configuration like this, the toner can be transported to the development area by the surface movement of the toner bearing member without depending on the toner hopping in a fixed direction.

Further, in the printer related to the first embodiment, a first electrode layer 42Y, which does not comprise an opening, and a second electrode layer 44Y, which comprises a plurality of openings a1, are provided as a plurality of electrode layers. In a configuration like this, it is possible to make the toner move back and forth by hopping between these two electrode layers.

Further, in the printer related to the first modification, one end of the first electrode layer 42Y in the X direction, which is the direction orthogonal to the endless movement direction of the toner bearing roller circumferential surface, is formed into an endless shape that extends in the circumferential direction, and the other end of the second electrode layer 44Y in the X direction is formed into an endless shape that extends in the circumferential direction, and a first contact electrode, which conducts a voltage to the first electrode layer 42Y while making contact with this one end, and a second contact electrode, which conducts a voltage to the second electrode layer 44Y while making contact with this other end are provided. In a configuration like this, pulse voltages can be applied to the respective electrode layers without going by way of the shaft member of the toner bearing roller.

Further, the printer related to the first embodiment utilizes a toner bearing member, which is a rotatable cylindrical shape, and, in addition, which provides a metal first flange 31Y that makes contact with the one end of the first electrode layer 42Y in the axial direction (X direction); a metal first shaft member 32Y that is rotatably supported by a bearing integrally formed thereto; a metal second flange 34Y that makes contact with the other end of the second electrode layer 44Y in the axial direction; and a metal second shaft member 35Y that is rotatably supported by a bearing integrally formed thereto. In a configuration like this, it is possible to apply an A-phase pulse voltage to the first electrode layer 42Y by way of the bearing that rotatably supports the first shaft member 32Y. Further, it is possible to apply a B-phase pulse voltage to the second electrode layer 44Y by way of the bearing that rotatably supports the second shaft member 35Y.

A power source 80 is provided for generating phase-shifted periodic pulse voltages to be supplied to the first electrode layer 42Y and the second electrode layer 44Y, respectively. In a configuration like this, it is possible to make the toner hop using a pulse voltage with a lower Vpp than a configuration in which a pulse voltage is only applied to either one of the electrode layers, and a direct current voltage (or ground) is applied to the other electrode layer.

Further, in the printer related to the first embodiment, a honeycomb structure in which a plurality of regular polygonal openings a1 is arranged in a matrix is provided as the second electrode layer 44Y. In a configuration like this, the inter-opening sizes of the plurality of spots between the openings that is formed between the respective openings a1 are the same as one another. Consequently, it is possible to avoid the variations in hopping performance resulting from different inter-opening sizes.

Further, in the printer related to the first embodiment, when the maximum value of the potential difference between the first electrode layer 42Y and the second electrode layer 44Y is expressed as Vmax [V], and the pitch between a regular polygonal opening a1 on the second electrode layer 44Y and a spot between openings is expressed as p [μm], satisfying the relationship Vmax/p>1 makes it possible to reliably form stable flares on the surface of the toner bearing roller.

Further, in the printer related to the first embodiment, a surface layer 45Y comprising a material that is capable of applying a load of normal charging polarity to a toner by the friction with the toner is disposed on the surface of the toner bearing roller 30Y. In a configuration like this, it is possible to avoid the occurrence of hopping defects resulting from the surface layer 45Y applying a load, which is the reverse polarity of the normal charging polarity, to the toner pursuant to slidingly rubbing against the hopping toner.

Further, the printer related to the first embodiment comprises a power source 80 so as to set the sum of an A-phase pulse voltage that is to be supplied to the first electrode layer 42Y and a B-phase pulse voltage that is to be supplied to the second electrode layer 44Y to a value between the latent image potential (image part potential) of the photosensitive belt and the background portion potential (non-image part potential). In a configuration like this, it is possible to make the toner hopping on the surface of the toner bearing roller 30Y reliably adhere to an electrostatic latent image in accordance with the potential difference between the sum of the two pulse voltages and the latent image potential. Furthermore, it is possible to reliably prevent the adherence (scumming) of the toner to the background portion resulting from the potential difference between the sum of the two pulse voltages and the background portion potential.

Further, since the printer related to the first embodiment provides a transfer roller 4 as transfer means for superposingly transferring a plurality of toner images formed on the photosensitive belt 1 to a recording paper, which is the transfer body, it is possible to form a color toner image by superposing toner images of a plurality of colors.

The effects of the present invention will be described hereinbelow.

(1) The toner on the surface of the toner bearing member is caused to hop between a plurality of spots between openings that respectively exist between a plurality of openings arranged in a matrix on the second electrode layer, and a plurality of spots directly beneath openings that exist on the first electrode layer directly beneath the plurality of openings in the second electrode layer. Since the plurality of spots between openings in the second electrode layer, which disposes a plurality of openings in a matrix, is interconnected like a mesh, even if any one of the spots between openings should fracture in the between-openings direction due to damage, voltages can continue to be supplied to all the spots between openings except this spot between openings that was fractured. Further, voltage from the surrounding spots between openings is supplied to the area in which electrode layer material remains even in a spot between openings that was fractured. Accordingly, even if any one of the spots between openings in the second electrode layer should be fractured, toner hopping performance is favorably maintained in the area in which electrode layer material remains in this spot between openings and in the other spots between openings just as if a fracture never occurred. Consequently, it is possible to suppress the generation of development defects caused by partial damage to the second electrode layer. Further, the first electrode layer, which exists beneath the second electrode layer, is not a configuration in which a plurality of strip-shaped electrodes are lined up as in the past, but rather can be an electrode layer having a large surface area that exists over practically the entire area of the surface of the toner bearing roller. In a first electrode layer like this, even if partial damage is incurred, voltage can continue to be applied to parts other than this damaged spot. Thus, even if partial damage should occur in the first electrode layer, toner hopping performance can be favorably maintained in the areas excluding this damaged spot just as if the damage had never occurred. Consequently, it is possible to suppress the generation of development defects caused by partial damage to the first electrode layer. As a result of the above, it is possible to suppress the generation of development defects caused by partial damage to the first electrode layer and the second electrode layer.

(2) The toner on the surface of the toner bearing member is caused to hop between a spot in a lowermost electrode layer directly beneath opposing openings and a spot directly beneath an opening in an intermediate electrode layer, is caused to hop between the spot directly beneath an opening in an intermediate electrode layer and a spot between openings on an uppermost electrode layer, and, in addition, is caused to hop between the spot between openings on the uppermost electrode layer and the spot in the lowermost electrode layer directly beneath opposing openings. Consequently, the toner on the surface of the toner bearing member moves to the development area by repeatedly hopping in the direction of alignment of the openings in the uppermost electrode layer and the intermediate electrode layer. That is, the direction of movement of the repeatedly hopping toner on the surface of the toner bearing member is the direction of alignment of the openings in the uppermost electrode layer and the intermediate electrode layer. Then, the plurality of spots on the lowermost electrode layer directly beneath opposing openings are lined up along the direction of movement of the repeatedly hopping toner (opening-alignment direction) and constitutes shapes that extend in a direction orthogonal to the direction of movement of the toner, the same as the strip-shaped A-phase electrode, B-phase electrode and C-phase electrode in the development device disclosed in Prior Art 1. Further, the plurality of spots in the intermediate electrode layer directly beneath openings is lined up along the direction of movement of the repeatedly hopping toner, and constitutes shapes that extend in the direction orthogonal to the toner movement direction.

Furthermore, the plurality of spots between openings on the uppermost electrode layer is lined up along the direction of movement of the repeatedly hopping toner, and constitutes shapes that extend in the direction orthogonal to the toner movement direction. In a configuration like this, the lowermost electrode layer, in which a plurality of openings need not be disposed, can be an electrode layer having a large surface area that exists over practically the entire area of the surface of the toner bearing member the same as the first electrode layer in (1) above. Thus, even if partial damage should occur in the lowermost electrode layer, toner hopping performance can be favorably maintained in the areas excluding this damaged spot just as if the damage had never occurred. Consequently, it is possible to suppress the generation of development defects caused by partial damage to the lowermost electrode layer. Further, in the intermediate electrode layer, non-opening spots respectively exist on both sides in the direction of extension of the intermediate electrode layers own openings. These non-opening spots all extend in the direction of movement of the repeatedly hopping toner, and either one of the non-opening spots is connected from the one end in the direction of extension of the respective openings to the plurality of spots directly beneath the openings that are lined up in the direction of movement of the toner. Further, the other non-opening spot is connected from the other end in the opening extension direction to the plurality of spots directly beneath the openings. In an intermediate electrode layer like this, even if either one of the plurality of spots directly beneath the openings having the same function as the conventional strip-shaped electrode should become fractured in the toner movement direction, which is the lateral direction, due to partial damage, voltage can be supplied to this spot directly beneath the opening from both sides in the opening extension direction, which constitutes the longitudinal direction, bordering on the fractured area. Accordingly, even if either one of the spots directly beneath an opening is fractured in the intermediate electrode layer, toner hopping performance is maintained favorably just as if the fracture never occurred. Consequently, it is possible to suppress the generation of development defects caused by partial damage to the intermediate electrode layer. Further, in the uppermost electrode layer, even if any one of the plurality of spots between openings having the same function as the conventional strip-shaped electrode should fracture in the lateral direction due to partial damage, for the same reason as the intermediate electrode layer, voltages will respectively be supplied from both sides in the longitudinal direction to this spot between openings bordering the fractured area. Accordingly, even if any one of the spots between openings on the uppermost electrode layer is fractured, this spot between openings will favorably maintain toner hopping performance the same as when there was no fracture. Consequently, it is also possible to suppress the generation of development defects caused by partial damage to the uppermost electrode layer. As a result of the above, it is possible to suppress the generation of development defects caused by partial damage to the uppermost electrode layer, the intermediate electrode layer, and the lowermost electrode layer.

Various modifications will become possible for those skilled in the art after receiving the teachings of the present disclosure without departing from the scope thereof.

What is claimed is:

1. A development device, which comprises a toner bearing member that causes a toner borne on its surface to hop, and which transports the toner that is hopping on the surface of the toner bearing member to a development area opposite a latent image bearing member of an image forming apparatus along with the surface movement of the toner bearing member, and develops a latent image on the latent image bearing member by causing the hopping toner to adhere to the latent image in the development area, the toner bearing member comprising:

a first electrode layer and a second electrode layer laminated so as to overlap one another in a normal direction with respect to the surface of the toner bearing member; and a plurality of openings which are provided in, of these electrode layers, the second electrode layer existing in the upper location that is closer to the surface of the toner bearing member and which are independently arranged in a matrix in both the direction of surface movement of the toner bearing member and an orthogonal-to-movement direction which is the direction orthogonal to the surface movement direction, these openings being provided over an entire latent image bearable area of the latent image bearing member in the orthogonal-to-movement direction, wherein the toner on the surface of the toner bearing member is caused to hop between a plurality of spots directly beneath the openings that respectively exist directly beneath the plurality of openings in the second electrode layer, and a plurality of spots between the openings that respectively exist between the plurality of openings in the second electrode layer, within an entire area of the first electrode layer in the surface direction of the toner bearing member.

2. The development device as claimed in claim 1, wherein an insulation layer made from an insulating material is disposed as a layer between the first electrode layer and the second electrode layer.

3. The development device as claimed in claim 1, wherein, one end of the first electrode layer in a direction that is orthogonal to the direction of endless movement of the circumferential surface of the toner bearing member is formed into an endless shape that extends in the direction of the circumferential surface, the other end of the second electrode layer in the direction that is orthogonal to the direction of endless movement of the circumferential surface of the toner bearing member is formed into an endless shape that extends in the direction of the circumferential surface, and there is provided a first contact electrode, which conducts a voltage to the first electrode layer while making contact with the one end, and a second contact electrode, which conducts a voltage to the second electrode layer while making contact with the other end.

4. The development device as claimed in claim 1, wherein the toner bearing member comprises a metal first flange which has the shape of a rotatable tube or cylinder and makes contact with one end of the first electrode layer in the axial direction of the toner bearing member, a first shaft member which is integrally formed to the first flange and is rotatably supported by a bearing, a metal second flange which makes contact with the other end of the second electrode layer in the axial direction of the toner bearing member, and a second shaft member which is integrally formed to the second flange and is rotatably supported by a bearing.

5. The development device as claimed in claim 1, further comprising a power source that generates phase-shifted periodic pulse voltages to be supplied to the first electrode layer and the second electrode layer, respectively.

6. The development device as claimed in claim 5, wherein the second electrode layer has a honeycomb structure in which a plurality of the openings having a regular polygonal shape are arranged in a matrix.

7. The development device as claimed in claim 6, wherein, when a maximum value of a potential difference between the first electrode layer and the second electrode layer is given as Vmax [V], and a pitch between the regular polygonal opening and a spot between openings on the second electrode layer is given as p [μm], the relationship $V_{max}/p>1$ is satisfied.

8. The development device as claimed in claim 1, wherein a surface layer, which comprises a material capable of applying a normal charging polarity charge to the toner as a result of friction with the toner, is provided on the surface of the toner bearing member.

9. A development device, which comprises a toner bearing member that causes a toner borne on its surface to repeatedly hop in a prescribed direction, and which moves the toner on the surface of the toner bearing member to a development area opposite a latent image bearing member of an image forming apparatus by the repeated hopping in the prescribed direction, and develops a latent image on the latent image bearing member by causing the hopping toner to adhere to the latent image in the development area, the toner bearing member comprising:

three or more electrode layers laminated so as to overlap one another in a normal direction with respect to the surface of the toner bearing member; and a plurality of openings which are provided in, of these electrode layers, an uppermost electrode layer existing in the uppermost location that is closest to the surface of the toner bearing member, and an intermediate layer existing between the uppermost electrode layer and a lowermost electrode layer existing in the lowermost location that is the furthest away from the surface of the toner bearing member, the openings extending in the surface direction of the toner bearing member, which is a direction that is orthogonal to the prescribed direction, and being aligned in the prescribed direction, wherein the toner on the surface of the toner bearing member is caused to move in the prescribed direction by causing the toner to hop between a spot directly beneath opposing openings, which is a lowermost electrode layer spot that exists directly beneath an uppermost electrode layer opening and an intermediate electrode layer opening that face one another in a lamination direction, and a spot directly beneath an opening, which is a spot between openings on the intermediate electrode layer, and is also a spot that exists directly beneath an opening in the uppermost electrode layer, causing the toner to hop between the spot directly beneath the opening in the intermediate electrode layer and a spot between the openings, which is a spot on the uppermost electrode layer between its own openings, and causing the toner to hop between the spot between the openings on the uppermost electrode layer and the spot directly beneath the opposing openings on the lowermost electrode layer.

10. The development device as claimed in claim 9, wherein an insulation layer made from an insulation material is respectively disposed as a layer between the uppermost electrode layer and the intermediate electrode layer, and a layer between the intermediate electrode layer and the lowermost electrode layer.

11. The development device as claimed in claim 9, wherein a surface layer, which comprises a material capable of applying a normal charging polarity charge to the toner as a result of friction with the toner, is provided on the surface of the toner bearing member.

12. An image forming apparatus, comprising:

a latent image bearing member for bearing a latent image; and a development device for developing the latent image on the latent image bearing member, wherein the development device comprises a toner bearing member that causes a toner borne on its surface to hop, and transports the toner that is hopping on the surface of the toner bearing member to a development area opposite the latent image bearing member of the image forming apparatus along with the surface movement of the toner bearing member, and develops the latent image on the latent image bearing member by causing the hopping toner to adhere to the latent image in the development area, the toner bearing member comprising:

a first electrode layer and a second electrode layer laminated so as to overlap one another in a normal direction with respect to the surface of the toner bearing member; and a plurality of openings which are provided in, of these electrode layers, the second electrode layer existing in the upper location that is closer to the surface of the toner bearing member and which are independently arranged in a matrix in both the direction of surface movement of the toner bearing member and an orthogonal-to-movement direction which is the direction orthogonal to the surface movement direction, these openings being provided over an entire latent image bearable area of the latent image bearing member in the orthogonal-to-movement direction, and wherein the toner on the surface of the toner bearing member is caused to hop between a plurality of spots directly beneath the openings that respectively exist directly beneath the plurality of openings in the second electrode layer, and a plurality of spots between the openings that respectively exist between the plurality of openings in the second electrode layer, within an entire area of the first electrode layer in the surface direction of the toner bearing member.

13. The image forming apparatus as claimed in claim 12, wherein the development device further comprises a power source that sets a sum of a pulse voltage to be supplied to the first electrode layer and a pulse voltage to be supplied to the second electrode layer to a value between an image part potential and a non-image part potential of the latent image bearing member regardless of phases of the pulse voltages.

14. The image forming apparatus as claimed in claim 12, further comprising transfer means for superposingly transferring a plurality of toner images formed on the latent image bearing member to a transfer body.

15. An image forming apparatus comprising:

a latent image bearing member for bearing a latent image; and a development device for developing the latent image on the latent image bearing member, wherein the development device comprises a toner bearing member that causes a toner borne on its surface to repeatedly hop in a prescribed direction, and which moves the toner on the surface of the toner bearing member to a development area opposite the latent image bearing member of the image forming apparatus by the repeated hopping in the prescribed direction, and develops a latent image on the latent image bearing member by causing the hopping toner to adhere to the latent image in the development area, the toner bearing member comprising:

three or more electrode layers laminated so as to overlap one another in a normal direction with respect to the surface of the toner bearing member; and a plurality of openings which are provided in, of these electrode layers, an uppermost electrode layer existing in the uppermost location that is closest to the surface of the toner bearing member, and an intermediate layer existing between the uppermost electrode layer and a lowermost electrode layer existing in the lowermost location that is the furthest away from the surface of the toner bearing member, the openings extending in the surface direction of the toner bearing member, which is a direction that is orthogonal to the prescribed direction, and being aligned in the prescribed direction, wherein the toner on the surface of the toner bearing member is caused to move in the prescribed direction by causing the toner to hop between a spot directly beneath opposing openings, which is a lowermost electrode layer spot that exists directly beneath an uppermost electrode layer opening and an intermediate electrode layer opening that face one another in a lamination direction, and a spot directly beneath an opening, which is a spot between the openings on the intermediate electrode layer, and is also a spot that exists directly beneath an opening in the uppermost electrode layer, causing the toner to hop between the spot directly beneath the opening in the intermediate electrode layer and a spot between the openings, which is a spot on the uppermost electrode layer between its own openings, and causing the toner to hop between the spot between the openings on the uppermost electrode layer and the spot directly beneath the opposing openings on the lowermost electrode layer.

16. A development device, which comprises a toner bearing member which develops a latent image on a latent image bearing member, and which is cylindrical in shape, the toner bearing member comprising:

a first electrode layer and a second electrode layer laminated via an insulation layer in a normal direction with respect to a cylindrical surface of the toner bearing member; and a plurality of openings which are provided in the second electrode layer existing in an upper location that is closer to an outer surface of the toner bearing member and which are independently arranged regularly in a circumferential face of the second electrode layer, a plurality of spots which are provided between the plurality of openings, wherein the plurality of spots surrounds the plurality of openings and is interconnected.

17. The development device as claimed in claim 16, wherein the openings of plurality of openings are independently arranged in a matrix in both a direction of surface movement of the toner bearing member and an orthogonal-to-movement direction which is a direction orthogonal to the surface movement direction.

18. The development device as claimed in claim 16, wherein the plurality of spots surrounds the plurality of openings like a mesh.

19. The development device as claimed in claim 16, wherein, one end of the first electrode layer in a direction that is orthogonal to a direction of endless movement of the circumferential surface of the toner bearing member is formed into an endless shape that extends in a direction of the circumferential surface, another end of the second electrode layer in the direction that is orthogonal to the direction of endless movement of the circumferential surface of the toner bearing member is formed into an endless shape that extends in the direction of the circumferential surface, and there is provided a first contact electrode, which conducts a voltage to the first electrode layer while making contact with the one end, and a second contact electrode, which conducts a voltage to the second electrode layer while making contact with the other end.

20. The development device as claimed in claim 16, further comprising a power source that generates phase-shifted periodic pulse voltages to be supplied to the first electrode layer and the second electrode layer, respectively.

21. The development device as claimed in claim 16, wherein, when a maximum value of a potential difference between the first electrode layer and the second electrode layer is given as Vmax [V], and a pitch between a regular polygonal opening and a spot between openings on the second electrode layer is given as p [βm], the relationship Vmax/p > 1 is satisfied.

22. An image forming apparatus, comprising:

a latent image bearing member for bearing a latent image; and a development device for developing a latent image on a latent image bearing member, wherein the development device comprises a toner bearing member which is cylindrical in shape, the toner bearing member including a first electrode layer and a second electrode layer laminated via an insulation layer in a normal direction with respect to a cylindrical surface of the toner bearing member, a plurality of openings which are provided in the second electrode layer existing in an upper location that is closer to an outer surface of the toner bearing member and which are independently arranged regularly in a circumferential face of the second electrode layer, and a plurality of spots which are provided between the plurality of openings, wherein the plurality of spots surrounds the plurality of openings and is interconnected.

23. The image forming apparatus as claimed in claim 22, wherein the openings of the plurality of openings are independently arranged in a matrix in both a direction of surface movement of the toner bearing member and an orthogonal-to-movement direction which is a direction orthogonal to the surface movement direction.

24. The image forming apparatus as claimed in claim 22, wherein the plurality of spots surrounds the plurality of openings like a mesh.

* * * * *